US009730494B1

(12) United States Patent
Feinstein

(10) Patent No.: US 9,730,494 B1
(45) Date of Patent: Aug. 15, 2017

(54) SELF-FITTING, SELF-ADJUSTING, AUTOMATICALLY ADJUSTING AND/OR AUTOMATICALLY FITTING SHOE/SNEAKER/FOOTWEAR

(71) Applicant: Peter A. Feinstein, Shavertown, PA (US)

(72) Inventor: Peter A. Feinstein, Shavertown, PA (US)

(73) Assignee: Feinstein Patents, LLC, Wilkes-Barre, PA (US)

( * ) Notice: Subject to any disclaimer, the term of this patent is extended or adjusted under 35 U.S.C. 154(b) by 0 days.

(21) Appl. No.: 15/274,316

(22) Filed: Sep. 23, 2016

(51) Int. Cl.

| | |
|---|---|
| ***A43C 11/00*** | (2006.01) |
| ***A43C 11/14*** | (2006.01) |
| ***A43B 1/00*** | (2006.01) |
| ***A43B 3/00*** | (2006.01) |
| ***A43B 23/02*** | (2006.01) |
| ***A43B 23/26*** | (2006.01) |

(52) U.S. Cl.
CPC ..... *A43C 11/1493* (2013.01); *A43B 1/0054* (2013.01); *A43B 3/0005* (2013.01); *A43B 23/028* (2013.01); *A43B 23/0215* (2013.01); *A43B 23/0225* (2013.01); *A43B 23/26* (2013.01); *A43C 11/008* (2013.01)

(58) Field of Classification Search
CPC ... A43C 11/008; A43C 11/14; A43C 11/1493; Y10T 24/2183; A43B 3/0005; A43B 1/0054; A43B 23/028; A43B 23/0215; A43B 23/26; A43B 23/0225
USPC ..... 36/50.1, 50.5; 24/68 SK
See application file for complete search history.

(56) References Cited

U.S. PATENT DOCUMENTS 5,713,143 A 2/1998 Kendall
6,598,322 B2 * 7/2003 Jacques ..... A43B 3/0005 36/127

(Continued)

FOREIGN PATENT DOCUMENTS

JP 2013230191 A 11/2013

OTHER PUBLICATIONS

Giuseppe Caprara, "An instant, custom-fitted shoe technology for the perfect footwear", Horizon 2020—The EU Framework Programme for Research and Innovation. Apr. 6, 2014, 3 pages.

*Primary Examiner* — Nathan Durham
*Assistant Examiner* — Abby Spatz
(74) *Attorney, Agent, or Firm* — St. Onge Steward Johnston & Reens, LLC

(57) ABSTRACT

Provided is a self-fitting and automatically adjustable footwear wherein the shoe upper and/or shoe tongue have or are attached to a shape memory material ('SMM"). Upon stimulation, the SMM deforms and brings the footwear to self-assemble about a foot, which further brings two clasp members close to each other and facilitates the clasp thereof to form a self-assembled and closed footwear. The clasp members may be integrated with straps or shoelaces, and optionally SMM. The footwear may include a motor, a control unit, and sensors which enable a motor-actuated fine tensioning of the footwear. A push button to enable manual opening of the footwear may be affixed on the footwear or removably attached to multiple surfaces/locations. The entire assembly generates data transmittable to health care providers and other data trackers. The footwear may include a battery, which may be charged by placing the footwear on a charge dock station.

22 Claims, 16 Drawing Sheets

(56) References Cited

U.S. PATENT DOCUMENTS

| | | | | |
|---|---|---|---|---|
| 6,691,433 | B2 * | 2/2004 | Liu | A43B 3/0005 24/68 SK |
| 6,865,825 | B2 | 3/2005 | Bailey, Sr. et al. | |
| 7,188,439 | B2 | 3/2007 | DiBenedetto et al. | |
| 7,258,207 | B2 | 8/2007 | Ohnishi et al. | |
| 7,310,895 | B2 | 12/2007 | Whittlesey et al. | |
| 8,480,760 | B2 | 7/2013 | Hansen et al. | |
| 8,525,386 | B2 | 9/2013 | Pas et al. | |
| 8,769,844 | B2 | 7/2014 | Beers et al. | |
| 8,935,860 | B2 | 1/2015 | Torres | |
| 2002/0078596 | A1 * | 6/2002 | Towns | A43B 1/0054 36/50.1 |
| 2013/0291399 | A1 | 11/2013 | Fonte et al. | |
| 2013/0303957 | A1 * | 11/2013 | Bauerfeind | A61F 5/0111 602/44 |
| 2014/0068838 | A1 | 3/2014 | Beers et al. | |
| 2014/0070042 | A1 | 3/2014 | Beers et al. | |

* cited by examiner

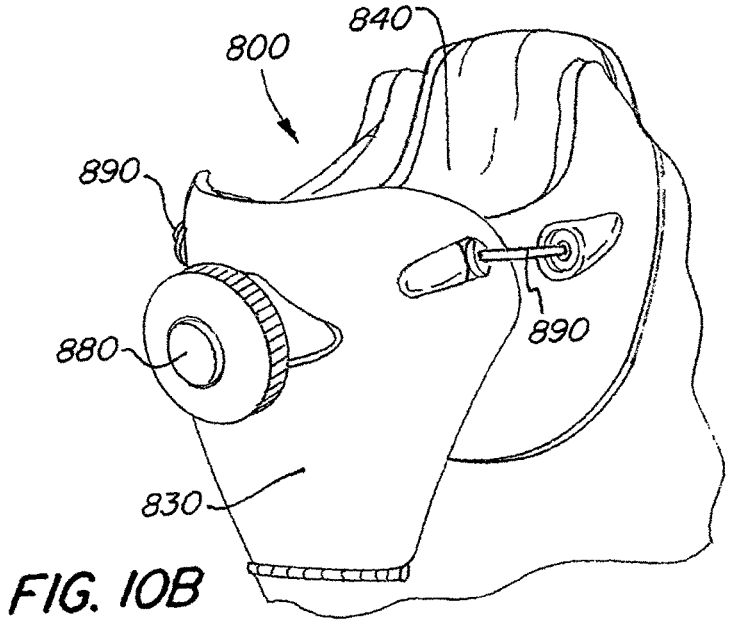
FIG. 10B
FIG. 10C
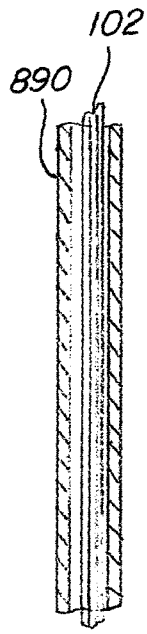
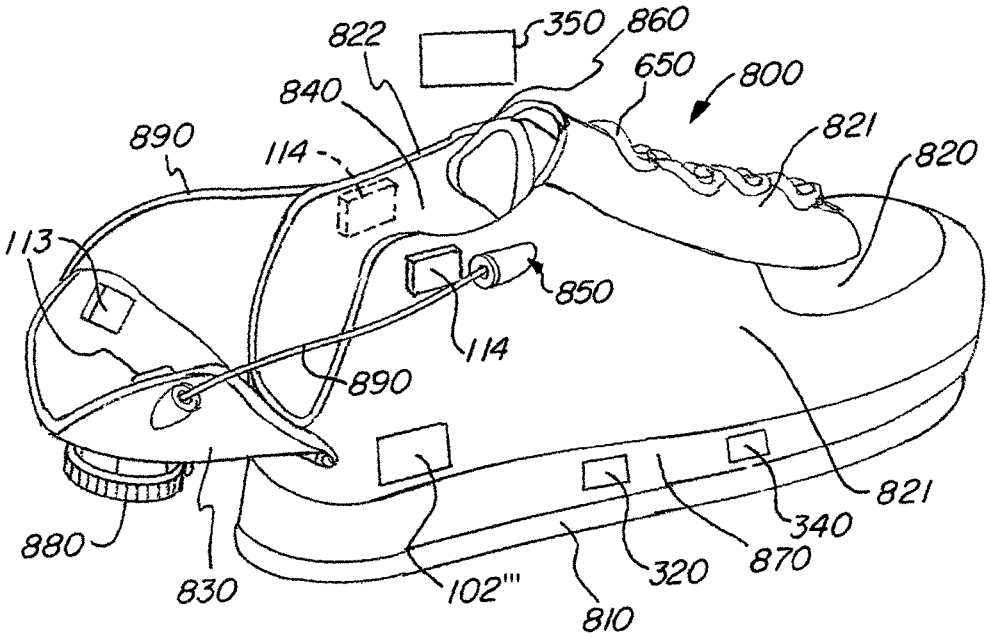
FIG. 10A

SELF-FITTING, SELF-ADJUSTING, AUTOMATICALLY ADJUSTING AND/OR AUTOMATICALLY FITTING SHOE/SNEAKER/FOOTWEAR

FIELD OF THE INVENTION

The invention relates generally to a footwear with self-fitting, self-adjusting, automatically adjusting and/or automatically fitting capability.

BACKGROUND OF THE INVENTION

The most common form of closure mechanism for a shoe is a lace, criss-crossing between the medial and lateral portions of the shoe upper, that is pulled tight around the instep of the foot and tied in a knot by the wearer. While simple and practical in functionality, shoelaces need to be tied by hand and often retied as they naturally loosen around the wearer's foot. Young children who have not yet learned to tie a knot require assistance from an attentive parent or caregiver. Elderly people with arthritic hands may find it difficult to pull shoelaces tight and tie knots in order to secure the shoes on their feet. People with arthritic backs, hips, knees or feet may find it difficult to bend over enough or move the affected lower extremity joint enough to put on or take off footwear or to tie shoes. Obese or handicapped people may have similar issues. Diabetic patients and patients with peripheral vascular disease need to be careful not to put on footwear that is too tight causing problems leading to diabetic ulcers, skin breakdown and loss of limb. The general population desires shoe, sneaker, or footwear that is comfortable, easy to apply and remove, and does not require adjustment once it is on the foot.

In order to alleviate problems associated with putting on shoes and other footwear and tying laces, shoes for children and adults have been provided with Velcro® hook-and-loop straps in lieu of the shoelaces. Such shoes require a user to grasp a strap secured to one end of the shoe and fasten to a complimentary Velcro® hook-and-loop patch secured to the other side of the shoe in order to close the shoes.

Both of the above shoe closure mechanisms require the use of at least one hand to hold a shoelace or a strap to close a shoe. Neither of them allow automatic adjustment of the fitting of a shoe which may become loose during wearing as a result of a person's daily activities.

A footwear with a tensioning system for automatically lacing, tightening or loosening a shoe on a foot has been reported.

U.S. Pat. No. 6,598,322 discloses a shoe having at least one elongated shape memory alloy element in the upper part of the shoe and an electric circuit which when energized will produce a tightening of the shoe upper around the foot of a wearer. A battery contained in the shoe provides a power source to produce a current in the circuit that heats the shape memory alloy and causes the shape memory alloy to reduce its length, resulting in tightening of the shoe uppers.

U.S. Pat. No. 7,310,895 provides golf shoes which include at least one sensor, a controller, and at least one active-response element. The sensor and the controller operate to rapidly determine if a golfer is walking or swinging a golf club. Once the determination is made, the controller and active-response element rapidly and automatically change the shoe's characteristics by adjusting the sole, lace, and/or upper part.

U.S. Pat. No. 8,769,844 is directed to an automatic lacing system for footwear in response to sensed information. The automatic lacing system provides a set of straps which are engaged with motors and which can be automatically opened and closed to switch between a loosened and a tightened position of the upper by the movement of the motors.

U.S. Pat. No. 8,935,860 is directed to footwear which sets itself to a customized, desired contour fit when a wearer's foot is inserted. According to the invention, there is a pressure sensor tucked away in the heel of the shoe along with a memory chip which stores the desired fit-that is, the tension on the shoe straps. The tension on the shoe straps is adjustable by one strap tightener. The strap tightener may be an electric motor powered by the battery. Alternatively, the strap tightener may be made of elongated shape memory alloy elements, which, when energized by an electric circuit, deform and tighten the shoelaces.

Despite the above self-adjusting footwear in the art, there is still a need to provide an improved footwear for hands-free operation. Preferably, the footwear is able to self-close its shoe upper when a wearer puts his/her foot into the footwear and further secure the closure with a securing mechanism. More preferably, the footwear is able to automatically adjust the fit of the footwear to a preset level of tightness upon the initial closure and also during a course of daily activities. Even more preferably, the footwear is able to automatically loosen and open for release of the foot upon receiving a signal.

SUMMARY OF THE INVENTION

The present invention provides a self-fitting and automatically adjustable footwear for the population in general, which is particularly suitable for young children, elderly people, obese people, handicapped individuals, wheelchair bound and ambulatory compromised people, patients with diabetic feet or peripheral vascular disease, and those with arthritic hands, backs, hips, knees, and feet.

According to one embodiment, the present invention provides a footwear which comprises a shoe sole and a shoe upper, wherein the shoe upper comprises a heel portion, a lateral portion, and a medial portion. The distal end of the shoe upper is fixed to the shoe sole. In the upper section or proximal end of the shoe upper, there is a gap between the lateral and medial portions. This gap may or may not include a tongue of the shoe. To control the opening and closing of the gap, a plurality of clasp straps are attached to the lateral and medial portions. The clasp straps contain a shape memory material (SMM) and are attached to pairs of clasp members. A trigger source is provided to send a stimulus to the shape memory material upon receiving a signal (e.g., upon detecting a foot stepping into the footwear). The shape memory material is configured to change between a memorized shape and a temporary shape around a foot in response to the stimulus, which brings the clasp straps closer to each other, and accordingly, brings the clasp members closer to one another, thereby facilitating the clasp of the clasp members and the close of the gap. The closing of the clasp straps may be programmed so that they will close sequentially. In preferred embodiments, the clasp members are magnetic clasp members.

According to another embodiment, the present invention provides a footwear which is similar to the above embodiment except that the footwear utilizes a conventional lace system instead of the clasp bands. The shoelace is looped criss-crossingly onto the anchors provided on the lateral and medial portions. The shoelace comprises a shape memory material. A trigger source is provided to send a stimulus to the shape memory material upon receiving a signal. The lateral and medial portions are attached to clasp members. Upon stimulation, the shape memory material changes between a memorized shape and a temporary shape around a foot in response to the stimulus, which brings the lateral and medial portions closer to each other, and accordingly, brings the clasp members closer to one another, thereby facilitating the clasp of the clasp members and the close of the gap. The phase transition of the shoelace may be programmed so that the shoelace is tightened sequentially, loop by loop. The phase transition of the shoelace may also be accomplished by staggering interwoven or intercalated fragments of shape memory material within the lace at different locations or intervals in order to potentiate or make additive the specific phase change displacements in the material(s) so as to accomplish a greater distance or radius of closure intrinsic to the shoelace itself.

In another embodiment, the shoelace, acting as a different approach to the strap/band portion of the strap/band clasp assembly, may be anchored to one of the lateral and medial portions and when automatically "tied" to the other upper, does so by automatically moving and positioning itself through changes in the shape memory material and/or with the aid of a motorized hinge at its base anchor, so that its end loop fits around a post on the other upper, looping around the post and then automatically tightening to close (or loosening to open), rather than using a mating set of magnets to lock the mechanism. The end of the loop that engages the receiving post can be a semicircle, a slipknot, a hoop or any other configuration.

In another embodiment, the end loop of the shoelace can be incorporated into or attached to the magnetic clasp described above as an alternative to the strap/band assembly.

In another embodiment, the lateral and medial portions may have the basic attachment of the strap/band to a motorized hinge to facilitate the motion from a completely splayed open upper configuration to a semi-enclosed upper position to initially enclose the foot allowing for the rest of the adjustment to take place through the SMM band/strap and/or clasp mechanism.

In another embodiment, the lateral and medial portions do not have to move at all, and closure/enveloping the foot is accomplished using the mechanisms described above to cause desired movements by the tongue portion of the shoe closing the gap between the uppers, like a clamshell closure using the fixed end of the shoe as the hinge of the closure.

According to a further embodiment, the present invention provides a footwear which comprises a sole and an upper, wherein the upper comprises a first flap and a second flap. Both of the flaps are made of a shape memory material and a non-shape memory material and are attached to at least one pair of clasp members. A trigger source is provided to send a stimulus to the shape memory material upon receiving a signal. The shape memory material is configured to change between a memorized shape and a temporary shape around a foot in response to the stimulus, which brings the flaps closer to each other, and accordingly, brings the clasp members closer to one another, thereby facilitating the clasp of the clasp members and the close of the flaps about the foot without need of the strap/band assembly. In preferred embodiments, the clasp members are magnetic clasp members.

According to yet another embodiment, the present invention provides a footwear which comprises a shoe sole and a shoe upper, wherein the shoe upper has a lateral portion, a medial portion, a heel portion, and an opening for receiving or removal a foot. The heel portion is pivotally connected to the first and the second lateral portions by a connection between the heel portion and the shoe sole. A cable is coupled to the lateral portion, the heel portion, and the medial portion to form a loop. Preferably, the cable may connected to or incorporated into a shoelace of the footwear. A shape memory material is disposed in the cable. A trigger source is provided to send a stimulus to the shape memory material upon receiving a signal. The shape memory material is configured to change between a memorized shape and a temporary shape around a foot in response to the stimulus, which pulls the heel portion towards to the lateral and medial portions, thereby facilitating the closing of the footwear.

In the above embodiments, preferably, the clasp is magnetic clasp, the trigger source is application of electric current, and the shape memory material comprises a shape memory alloy (e.g., nitinol).

In preferred embodiments only one shape memory material is needed, employing it in certain straps/bands to move in one direction (closing) and in other strap/band-clasp assemblies to close its radius, contract, or change in the opposite or reverse direction (open) depending on its position or orientation in relation to the shoe upper or moving portion of the footwear. Alternatively, each strap/band-clasp or shoelace assembly can have more than one loop of shape memory material (e.g. two nitinol loops), the first programmed to close the strap/band and the second loop installed to work in the reverse direction simple by reversing the orientation of the contractile response by providing the equivalent of a reverse stimulus (e.g. the electric current comes to the second nitinol loop from the opposite direction).

In other preferred embodiments, the shape memory material comprises two shape or more memory materials. The two shape memory materials provide counteracting actuation such that a first shape memory material is configured to shape transition in a first direction in response to a first stimulus and a second shape memory material is configured to shape transition in a second direction in response to a second stimulus simultaneously, the second direction being opposite the first direction. A preferred stimulus is application of electric current. Another stimulus may be heat from a blower as used to change the configuration of a shrink wrapping material. However, a heat stimulus may only be used on shoes to be worn by a healthy person, for example, a person without a diabetic foot. Yet another stimulus may be a RFID signal, an infrared, a laser beam or other type of light signal.

The above embodiments may further comprise a motor disposed in the footwear, sensors disposed on or beneath interior surfaces of the footwear, and a control unit in communication with the motor, and the sensors. The motor is configured to adjust a position of the clasp members with respect to one of the flaps in order to tighten or loosen the footwear. The control unit is configured to control activation and deactivation of the motor based on measurements provided by the sensors. With these configurations, the footwear of the present invention is able to automatically adjust the fitting of the footwear upon an initial closure and during the course of wearing.

In preferred embodiments, a remote (footwear hands free) user input unit is provided which communicates with the trigger source and the control unit. Instructions from the control unit may be overwritten by a user input. Alternative to hands free, but still consistent with easy operation, a push button may be placed on the shoe heel or on any other location, which may be used to instruct the trigger source to apply a stimulus to the shape memory material. The push button may also be programmed as an emergency measure—a push of the button would open a closed footwear and release the foot. This feature is important in the case the footwear fails to automatically enlarge the opening of the shoe to allow taking off the shoe, or if the shoe fails to automatically loosen a very tight fit. An alarm system to notify the user of a problem is part of the overall control system and push button default mechanism.

The footwear may comprise a disposable or rechargeable battery as a power source for the movement of motors, the creation of stimulus, etc.

A charge dock station may be use to receive the footwear for charging the battery therein, without the need to take out the battery. The docking system may serve other important functions of the hands free shoe wear system, such as having a motion detector/radar/lidar system to recognize the approaching foot and turn on the power to ready the closure mechanisms described above for implementation. It may also recognize whether a shoe placed on the dock is open or closed and prepare the shoe for use appropriately (i.e., in a sufficiently open position for placing a foot) making all of this also hands free.

The docking station is capable of picking up and providing information from its own sensors and has the capability to pick up information from sensors transmitting information located on or within the shoe. In addition to the sensors required to operate the hands free shoe mechanisms, these and other biometric or sensor groups may pick up parameters of foot health such as temperature, soft tissue swelling (increasing or decreasing over the course of a day with elevated or dependent positions), peripheral pulses (e.g. dorsalis pedis pulse—an integral part of peripheral vascular disease and diabetes examinations) and transmit wirelessly or by other means that data to the control unit for further action by a healthcare provider, or as a warning to the wearer that they need to contact their physician.

The control unit or the dock itself may contain a direct (e.g. internet/wireless) connection to the wearer's healthcare record (EMR) so as to be able to send this and other types of health monitoring information that is derived from foot health.

The same type of integration/communication can be established to various types of fitness bands/smart watches, etc. (e.g. number of steps taken, distance moved throughout the day, etc). Geographical position or location information can be gathered and transmitted.

To anyone skilled in the art, it is evident that information gathered and transmitted is not limited to the examples provided.

BRIEF DESCRIPTION OF THE DRAWINGS

FIGS. 10A and 10B are isometric and schematic views of yet another further embodiment of a footwear wherein the heel portion is hingedly attached to the shoe sole, in an open position and a closed position. FIG. 10C is an enlarged cross-sectional view of an embodiment of a cable used in the footwear of FIGS. 10A and 10B.

DETAILED DESCRIPTION OF THE INVENTION

The present invention provides a footwear which has an automatic closure and self-fitting function. The term "footwear" refers to any type of shoes having a sole and a relatively flexible upper, such as boots, sneakers, converses, golf shoes, Vibram® wrap around shoes, etc. Generally, a footwear includes two primary elements: an upper and a sole structure. The shoe upper may comprise medial and lateral portions and a heel portion. The shoe upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The footwear includes an opening near the heel of a footwear for entry and removal of the foot from the void within the upper. The footwear also may include a shoe tongue between the medial and lateral portions of the upper.

Figure 1A:
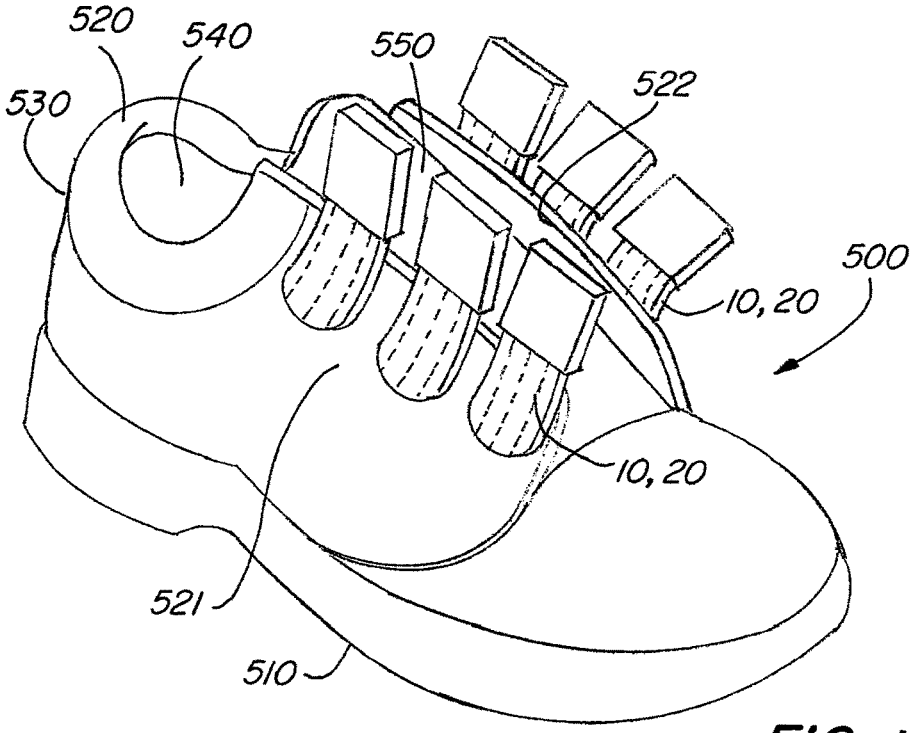
FIGS. 1A and 1B are isometric and schematic views of an embodiment of a footwear without a shoe tongue but having clasp straps/bands, in an open position and a closed position of the uppers.
Figure 1B:
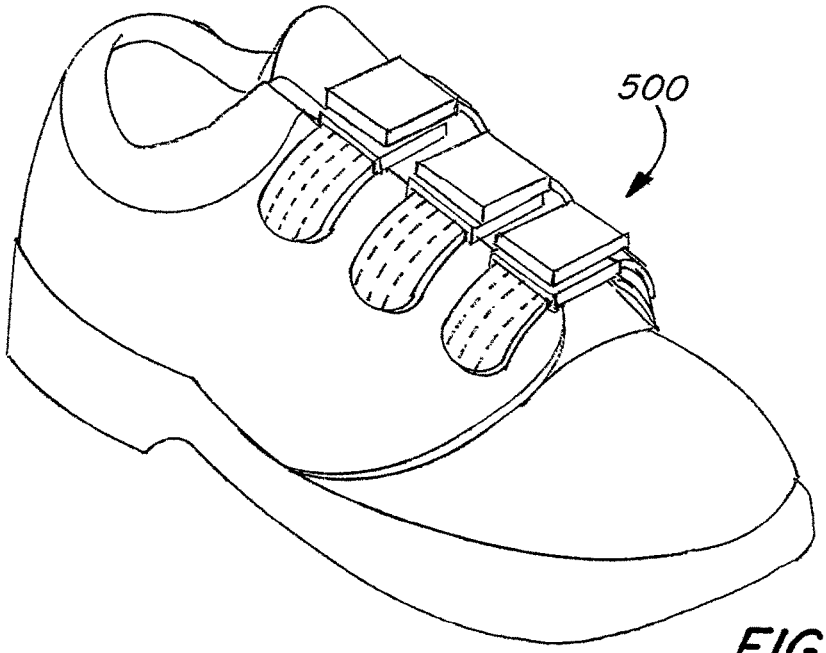
Figure 1C:
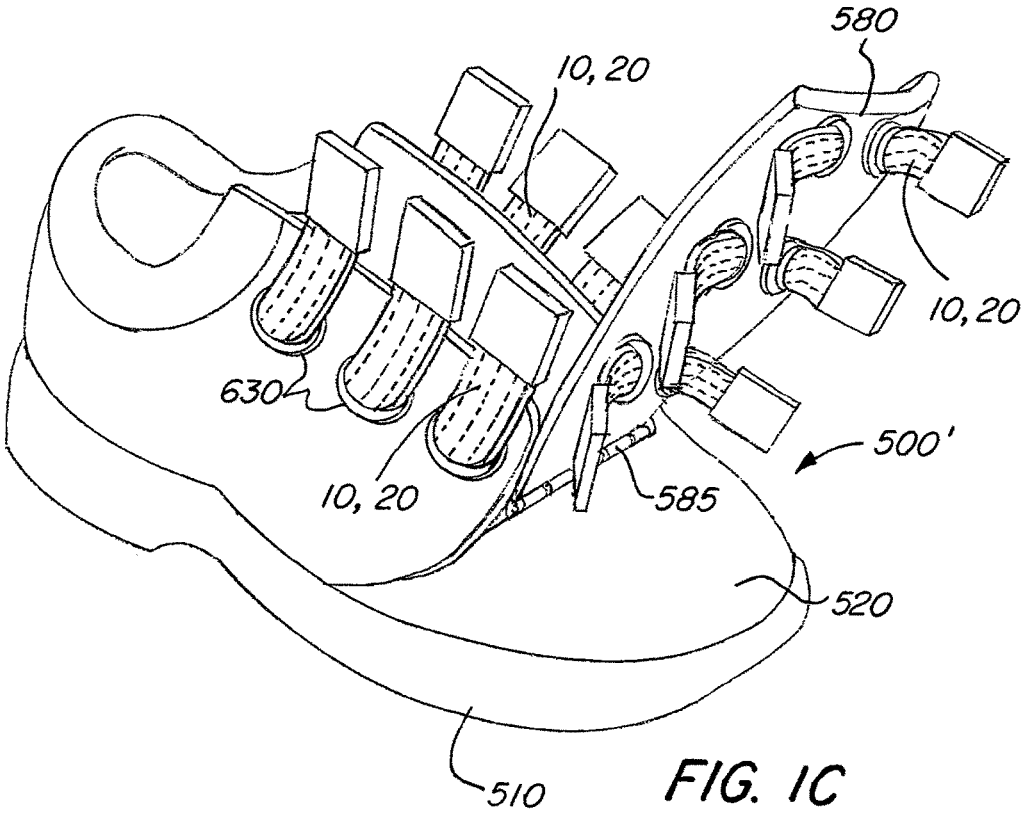
FIG. 1C is an isometric and schematic view of another embodiment of a footwear having a shoe tongue and clasp straps/bands, in an open position.

FIGS. 1A and 1B show a footwear 500 in accordance with one embodiment of the present invention. The footwear 500 comprises a shoe sole 510 and a shoe upper 520. The shoe upper 520 comprises a lateral portion 521, a medial portion 522, a heel portion 530, and an opening 540 for entry and removal of a foot. The distal end of each of the lateral and distal portions 521, 522 is fixed to the shoe sole, and the upper part or proximal end thereof has a closable gap 550 between the portions 521, 522. The gap 550 is connected to the opening 540 of the footwear 500. The gap 550 may be closed or substantially closed when the portions 521, 522 are brought together.

Alternatively or additionally, the gap 550 may be closed by a tongue 580 of the shoe which fits between the two upper halves (i.e., the lateral and medial portions), as shown in FIG. 10. The tongue 580 is attached to the shoe upper 520 at a tongue hinge 585. When the footwear 500 is in a closed position, the shoe tongue 580 may be positioned either on top of or underneath the two upper halves and thus covers the gap 550.

In lieu of conventional shoelaces, a plurality of clasp bands/straps 10, 20 are coupled to the lateral and medial portions 521 and 522 near the gap 550 of the footwear 500, as shown in FIGS. 1A and 1B. In some embodiments, there is a flexible middle and superior portion (i.e., tongue) of the shoe upper which is located underneath the clasp bands/straps 10, 20 to provide support and cushion. The clasp bands/straps 10, 20 on the lateral portion 521 match with the clasp bands/straps 10, 20 on the medial portion 522. The opening or closing of the clasp bands/straps 10, 20 determine whether the upper part of the two lateral and medial sides 521,522 is open (as shown in FIG. 1A) or closed (as shown in FIG. 1B).

The tongue 580 of the footwear 500 in FIG. 10 may also be equipped with the clasp bands/straps 10, 20 to open and close the footwear 500'. In this embodiment, the plurality of clasp bands/straps 10, 20 are coupled to the tongue 580, the lateral and medial portions 521 and 522 near the gap 550 of the footwear 500. The clasp bands/straps 10, 20 attached to the tongue 580 and near the lateral portion 521 match with the clasp bands/straps 10, 20 attached to the lateral portion 521 so that the opening or closing of the clasp bands/straps 10, 20 determine whether there is a gap between the lateral portion and the tongue. Likewise, the clasp bands/straps 10, 20 attached to the tongue 580 and near the medial portion 522 match with the clasp bands/straps 10, 20 attached to the medial portion 521 so that the opening or closing of those clasp bands/straps determine whether there is a gap between the medial portion and the tongue.

Figure 2A:
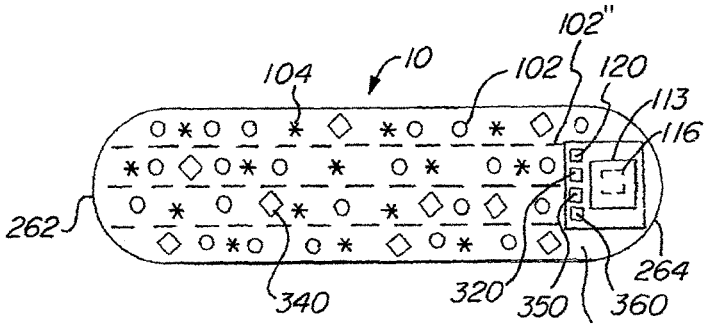
FIGS. 2A and 2B show an enlarged cross-sectional view and an isometric view of an embodiment of a clasp band/strap with parts removed to show internal details, in a disconnected position.
Figure 2B:
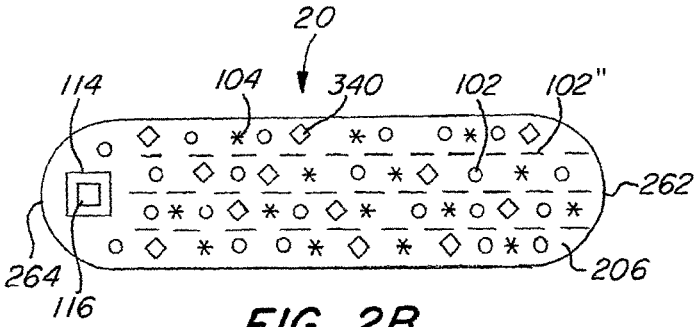
Figure 2C:
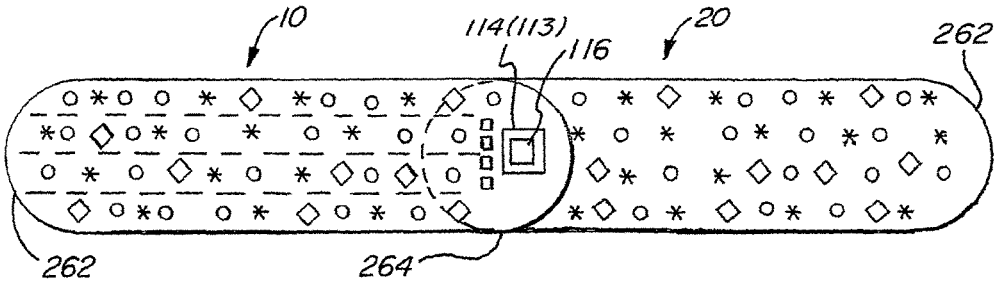
FIG. 2C shows an enlarged cross-sectional view and an isometric view of an embodiment of a clasp band/strap with parts removed to show internal details, in a connected position.

The details of the clasp bands/straps 10, 20 are illustrated in FIGS. 2A to 2C. The clasp bands/straps 10, 20 may be in an elongated form. The clasp bands/straps 10, 20 comprise shape memory materials 102, 102" and a non-shape memory material 104, which have different forms, such as particles, strings, wires, etc. They are symbolically shown as broken lines, circles, rectangles, or asterisks in the drawings. Together with respective reference characters, the broken lines, circles, rectangles, or asterisks can be used to distinguish one form of (non-)shape memory material to another. The clasp bands/straps 10, 20 may further comprise a liner 206 on which the shape memory materials 102, 102" and the non-shape memory material 104 are deposited. The clasp bands/straps 10, 20 may comprise a trigger source 120 in communication with the shape memory materials 102, 102" and configured to provide a stimulus to the shape memory materials 102, 102". Though the bands/straps as shown have substantially the same width, such consistency in width is not required for the functions of the clasp bands/straps.

The phrase "in communication with" with respect to the trigger source can mean that the trigger source has an effect, provides an effect, produces an effect on, and/or induces an effect on the shape memory material (e.g., transmit electricity to the shape memory material, pass a liquid to the shape memory material; transmit heat/cooling to the shape memory material; irradiate the shape memory material; adjust pH of shape memory material; effect a chemical reaction in the shape memory material, etc.). A preferred stimulus is application of electric current.

Each of the clasp bands/straps 10, 20 has a proximal end 262 and a distal end 264. A clasp having two clasp members is provided for a pair of the clasp bands/straps. FIGS. 2A and 2B show that the clasp members 113, 114 are attached to the distal ends 264 of the pair of clasp bands/straps 10, 20 so that the clasp may connect or disconnect the pair of clasp bands/straps.

The shape memory materials 102, 102" allows the pair of clasp bands/straps 10, 20 to transform from a physical phase to another physical phase upon receiving a stimulus (e.g., electric current), which causes the pair of clasp bands/straps 10, 20 to bend and its two distal end portions 264 to move toward each other. As the two end portions 264 move closer to each other, the two clasp members 113, 114 clasp to connect the two clasp bands/straps as shown in FIG. 2C and consequently close the shoe as shown in FIG. 1B. The clasp bands/straps 10, 20 or a fabric embedded with the shape memory material may be called smart fabric due to its ability to self-assemble.

Figure 3:
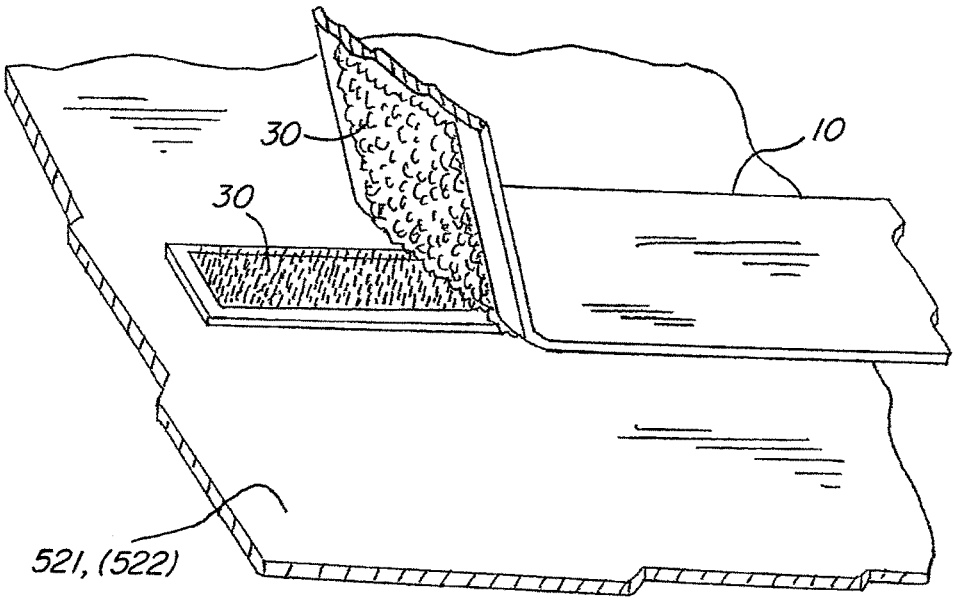
FIG. 3 shows an isometric view of an embodiment of backing of a clasp band/strap.

The clasp bands/straps 10, 20 have two opposite surfaces of substantially the same area and shape. In some embodiments, one surface of the clasp bands/straps 10, 20 attached to the lateral portion 521 may comprise a fastening means for connecting the clasp bands/straps 10, 20 attached to the medial portion 522, as shown in FIG. 3. This fastening mechanism may be utilized on both of the lateral and medial portions 521, 522, or on the shoe tongue portion 580 for either one or both clasp bands/straps 10,20, as discussed previously concerning FIGS. 1A, 1B, and 10. In preferred embodiments, the fastening means is a hook-and-loop fastener 30, such as a Velcro strap.

In preferred embodiments, the fastening means is a hook-and-loop fastener 30, such as a Velcro strap. This permits for initial setting in a gross manner to accommodate major foot size variations and large closure gap distances based on foot size, so that the motorized or self-assembly closure mechanisms can make the spatial connections needed to perform the fine adjustments and locking. It also allows for emergency footwear removal if the self-assembly mechanics fails. The user can simply tear the Velcro attachments apart to open the shoe if necessary.

In preferred embodiments, the shape memory materials 102, 102" comprise nitinol. In some of the preferred embodiments, the clasp-bands/straps may be structured like hinges for attaching one part of the shoe with another part of the shoe. Hinge-like clasp-bands/straps allow for a larger radius of closure when combined with the characteristics of nitinol. In further preferred embodiments, each hinge may be equipped with a small motor connected to a general feedback loop with nitinol (e.g., the loop formed as a result of clasp of the clasp bands/straps) so that the hinge accomplishes closure of the large gaps needed to be approximated where the nitinol radius of contraction is too small. The hinge assembly also allows for overall accommodation to foot size variations.

In some embodiments, the plurality of clasp bands/straps may be configured to close sequentially by having the clasp bands/straps at the lowest part of the upper part close first, before the adjacent clasp bands/straps close. This sequential clasp bands/straps can also be done in the reverse order for closure or for opening.

More than one sets of the shape memory material may be interspersed in the clasp bands/straps so that one set is activated work to close the upper and the other set is positioned and programmed to work in the opposite direction to open the upper.

The shape memory materials 102, 102" may be formed from of one or more shape memory polymers (SMPs), one or more shape memory alloys (SMAs), or a mixture thereof. Noticeable changes include the change of band/strap length and curving effect of the clasp bands/straps. When a stimulus is applied or fed to the shape memory material, the modulus of elasticity of the material can change from a rigid or semi-rigid state to a flexible, malleable state suitable for reshaping and stretching the material. In some embodiments, the stimulus comprises application of electric current. FIGS. 2A and 2B show a lateral cross-sectional view of the clasp bands/straps 10, 20 having shape memory materials 102, 102" in the form of wires and particles.

The SMP, SMA, mixture, composite, compound or fabric are shaped in such a manner such that they may feature distinctively shaped shape transitions, having different shape transition conditions, which may be initiated by different external factors or stimuli.

Suitable SMPs that may be used in the present invention include, but are not limited to, polyesters, polycarbonates, polyethers, polyamides, polyimides, polyacrylates, polyvinyls, polystyrenes, polyurethanes, polyethylene, polyether urethanes, polyetherimides, polymethacrylates, polyoxymethylene, poly-ϵ-caprolactone, polydioxanone, polyisoprene, styrene copolymer, styrene-isoprene-butadiene block copolymer, cyanate ester, copolymers of stearyl acrylate and acrylic acid or methyl acrylate, norbonene or dimethaneoctahydronapthalene homopolymers or copolymers, malemide, silicones, natural rubbers, synthetic rubbers, and mixtures and compositions thereof. Further, the SMPs may be reinforced or unreinforced SMP material.

Suitable SMAs that may be used in the present invention include, but are not limited to, copper-aluminum-nickel alloys, nickel-titanium alloys, copper-zinc-aluminum alloys, iron-manganese-silicon alloys, gold-cadmium, brass, ferromagnetic, other iron-based alloys, and copper-based alloys.

In a preferred embodiment, nitinol wires are used as the shape memory material. The nitinol wires, upon stimulation, will deform primarily in radius which creates both a tension and pressure type of adjustment. In one embodiment, the nitinol wires contract by about 4% to about 5% at 80° C.

Figure 4D:
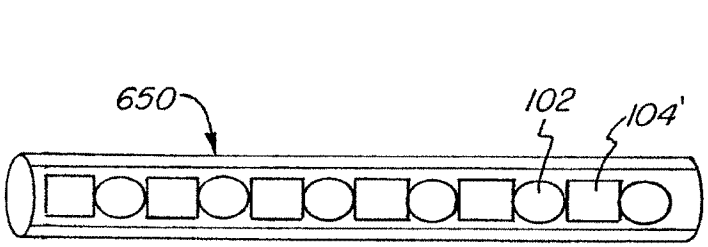
FIG. 4D shows this assembly of FIGS. 4A-4C encased or enclosed in a conventional shoelace fabric or other material.
Figure 4A:
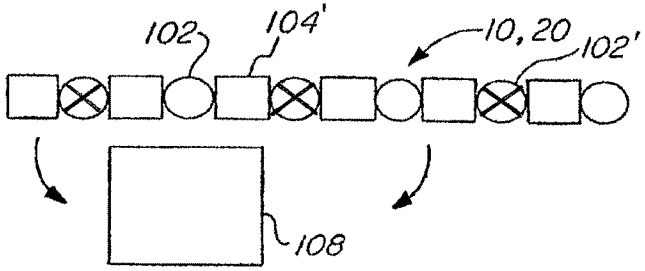
FIGS. 4A-4C are step views of a material having self-assembly and adaptive shape adjustment capability undergoing self-assembly around an underlying object and thereafter disassembly from the underlying object.
Figure 4B:
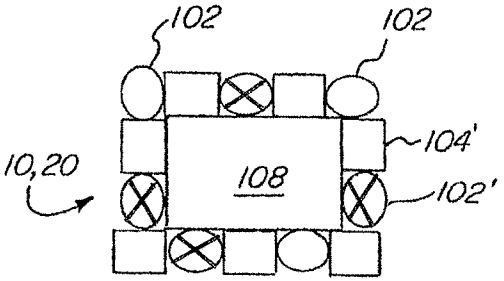
Figure 4C:
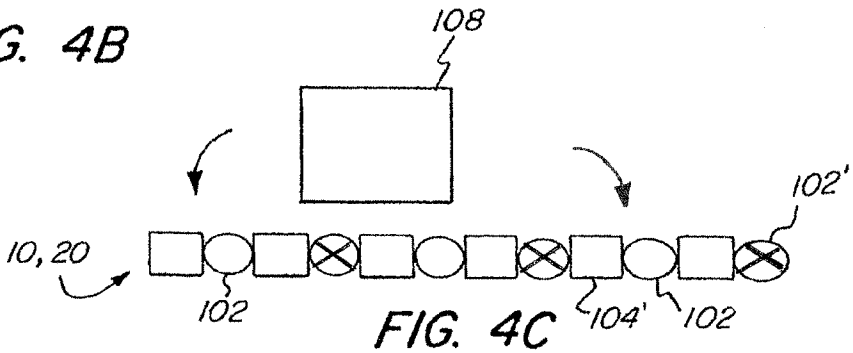

In some embodiments, the shape memory material comprises one or more than one shape memory material 102, 102' that are programmed to provide counteracting actuations independently timed or simultaneously, in different or similar directions, from the memorized shape, as illustrated in FIG. 4A. The counteracting actuation function similar to muscle contraction in which the biceps and triceps provide for flexion and extension of the elbow joint, thereby contributing to functional movement of the arm. The one, two, or more shape memory materials are adapted to counteract one another so that the clasp bands/straps 10, 20 are able to self-assemble from a memorized shape (see FIG. 4A for example) to a first temporary shape (see FIG. 4B for example), cease self-assembly and maintain the first temporary shape. Additionally, the counteracting actuations of the two or more shape memory materials provide for adaptive adjustment (gradualism) of the clasp bands/straps 10, 20 from the first temporary shape to other intermediate temporary shapes in order to compensate for changes in shape and/or size of the underlying object 108 (e.g., a foot). Thereafter, if a "removal" trigger is transmitted by the trigger source to the shape memory material, the clasp bands/straps 10, 20 may automatically disassemble in directions, opposite to the original directions, respectively, thereby reverting back to its memorized shape (e.g., flat shape), as shown in FIG. 4C. As such, the footwear of the present invention not only can be put onto a foot hands-free, it also may be removed from the foot hands-free under the same mechanism by using one SMM programmed to contract in the opposite or reverse radius or direction, or two or more shape memory materials that provide counteracting actuations in two directions.

In addition to clasp bands 10, 20, shoelaces may be imparted with self-assemble and self-fitting properties by incorporating the one or more than one shape memory material. FIG. 4D presents a schematic view of a shoelace 650 made of a conventional shoelace material or other suitable material, wherein non-shape memory material 104' and shape memory materials 102, 102' are disposed within or on the surfaces of the shoelace 650. The shoelace 650 is able to self-assemble (to close a shoe) and subsequently dissemble (to loosen and open a shoe) around a foot, under the similar mechanism as illustrated in FIGS. 4A to 4C. It should be noted that although it appears that the shape memory materials 102, 102' in FIGS. 4A-4C are in isolated particle shapes, in fact the shape memory material may be in the form of wires (such as nitinol wires) or other suitable shapes.

The term "a shape memory material", "a shape memory alloy", or "a shape memory polymer", although used in a singular form throughout this application, means both one and more shape memory materials/alloys/polymers. The one or more shape memory materials/alloys/polymers may provide actuation in one direction or counteracting actuations in two directions.

The non-shape memory materials 104, 104' may comprise, but is not limited to, one or more of the following materials: plastic, rubber, fabric, or mesh. The non-shape memory materials 104, 104' may provide some rigidity and structural stability to the overall arrangement of the smart material. However, the non-shape memory materials 104, 104' does not prevent the clasp bands/straps 10, 20 as a whole from transitioning between different shapes.

The liner 206 may be a form liner and/or a mesh layer. The mesh layer may comprise a plastic material or textile (e.g., fabric) material. The process of combining or intercalating the mesh layer and shape memory materials 102, 102" and non-shape memory materials 104, 104' may involve threading, casting, coating, welding, and/or bonding.

The clasp for use on the clasp bands/straps 10, 20 may be any type of clasp. Preferably, the clasp is a magnetic clasp. In that preferred embodiment, the clasp members 113, 114 comprise magnetic pieces 116, which may mutually attract and magnetically connect to each other to form an overlap to close the loop, without a prior physical contact. The magnetic pieces 116 may be of any suitable shapes. Since the magnetic force of attraction decreases with distance, this force is exerted most between the first and second magnet pieces when they are directly and substantially superposed on each other. Accordingly, not only should the two magnet pieces be matched magnets (namely, they are polarized in the same direction) so that they can be superposed on each other, the two magnet pieces also, preferably, have substantially the same size and same shape to maximize the exertion of magnetic force. The magnetic force between the magnet pieces causes the clasp members to adhere strongly to each other.

The magnet pieces may be permanent magnets made of neodymium-iron-boron. Those skilled in the art will understand that the mutually attracting magnetic pieces described previously could be electromagnetic fields or any other force types that can mutually attract and lock together. To provide additional magnetic shielding, the wearable band/strap may have removable or fixed magnet shields which are sufficiently large to attach and cover the outer surfaces of the band/strap. In a preferred embodiment, the shields are made of Mu shielding material.

The overlap formed by the magnetic pieces may have a tab, an indentation, or a button on an edge of the clasp members 113, 114 so that a user may easily lift up or push away one of the clasp members with a finger in order to open the engaged clasp members. A skilled artisan will understand that there are other mechanisms known in the art, such as an automatic mechanism with a remotely controlled motor, may be used to separate two attracted magnet pieces. Since the magnetic force of attraction decreases with distance, only an initial force is needed to break the attraction between the two magnet pieces. One advantage of the magnetic clasp in accordance with the present invention is that it can be easily operated (i.e., opened and closed) with a single hand or hands free.

Referring back to FIG. 10, because the shape memory material 102 is able to transition between a memorized shape and a temporary shape of the shape memory material upon receipt of a stimulus, the clasp straps/bands 10, 20 attached to the tongue 580, and optionally the clasp straps/bands 10, 20 attached to the lateral and medial portions 521, 522, deform upon stimulation, pulling the tongue 580 closer to the lateral and medial portions 521, 522. The pairs of clasp members (e.g., magnetic members) attached to the tongue 580 clasp with the matching clasp members attached to the lateral or medial portion 521, 522 are also brought closer to each other so as to clasp and close the opening between the lateral or medial portion 521, 522 and the tongue 580. Consequently, the footwear 500 is self-assembled around a foot. In some embodiments, only one shape memory material 102 is employed in the straps/bands 10, 20 to move in one direction (closing) and in other strap/band-clasp 10, 20 assemblies to close its radius, contract, or change in the opposite or reverse direction (open). In other embodiments, each strap/band-clasp 10, 20 assembly may have more than one loop of shape memory material 102, 102' (e.g. two nitinol loops), the first programmed to close the strap/band and the second loop installed to work in the reverse direction simple by reversing the orientation of the contractile response by providing the equivalent of a reverse stimulus.

In some preferred embodiments of the invention, the clasp bands/straps 10, 20 as shown in FIGS. 2A and 2B may further comprise at least one motor 320 for fine tuning the tightness of the clasp bands/straps initially and during the courses of use. The motor 320 can be disposed anywhere on or in the footwear. The clasp bands/straps 10, 20 may further comprise sensors 340 and a control unit 350 which is in communication with the sensors 340 and the at least one motor 320. The sensors 340 may be positioned on the clasp bands/straps 10, 20 and may be remotely positioned from the clasp bands/straps. The sensors 340 are configured to acquire information related to the clasp bands/straps 10, 20 and send sensed or acquired information (e.g., measurements) to the control unit 350.

Suitable sensors may be touch sensors, pressure sensors, force sensors, capacitive sensors, conductivity sensors, light or optical sensors, heat sensors, strain gauges, stress gauges, bend sensors, magnetic sensors, location sensors, accelerometer sensors, mechanical sensors (e.g., external buttons or levels, removable tabs/rods/latches, external sliders, bending-release latches, etc.), or a combination thereof or any additional type of sensor.

In some embodiments, the sensors are configured such that number, configuration, type and pattern of the sensors in contact with a foot determine timing for closing the shoe and tensioning of the shoe. A user may select number, configuration, type, and pattern of the sensors to be in contact with a foot and enter the selections in the user input unit so as to control timing for closing the shoe and tensioning of the shoe around a foot.

For an initial shoe closure, the sensors are preferably pressure or weight sensors. The sensors may be tucked away in the heel of the shoe. When a foot is stepped into a shoe, the sensors detect the weight or pressure change and trigger the application of a stimulus (e.g., electric circuit) to the shape memory material 102, which causes the shape memory material 102 to deform and the two end portions of the pair of clasp bands/straps 10, 20 to bend and approach one another. For subsequent adjustment of the fitting, the sensors may be touch sensors, pressure sensors, force sensors, heat sensors, or location sensors disposed on the interior surface of the footwear.

Based on the information received from the sensors 340, the control unit 350 may determine whether the motor 320 needs to be activated to loosen or tighten the clasp bands/straps 10, 20 and if so, the particular movement to be carried out by the motor 320 to reach the desired effect. The control unit 350 then sends triggering signals to the motors 320 to activate that movement. The movement of the motor 320 changes the relative position of the clasp 113, 114 with respect to the clasp band/strap 10, 20 thereby fine tuning the fitting of the footwear.

For example, if the measurements from the sensors 340 indicate that the clasp bands/straps 10, 20 are too loose, as compared to a threshold value, the control unit 350 may activate the motor 320 in order to tighten the clasp bands/straps 10, 20; conversely, if the measurements from the sensors 340 indicate that the fitting is too tight, as compared to a threshold value, the control unit 350 may activate the motor 320 in order to loosen the clasp bands/straps 10, 20. This process may also be characterized as a sensor triggered activation. When a threshold tightness level is reached after the motor movement and detected by the sensors 340, the sensors 340 will communicate with the control unit 350, which triggers the motors 320 to stop its movement. In some embodiments, the control unit 350 may be a central processing unit (CPU). In other embodiments, the control unit 350 may be a simple circuit for receiving inputs and providing an output according to the inputs to motors 320.

Additionally, the motor may be used to superimpose two matched magnet pieces on each other for maximum magnetic force. In some embodiments, the control unit is configured so that, before clasping, the control unit instructs the motor to adjust the position of the second clasp member so that the two distal ends are aligned on top of each other with a magnetic piece on each end facing each other, thereby facilitating the two magnetic pieces to clasp by magnetic force.

The various components of the control unit 350 may be disposed in many places and communicate with each other via Bluetooth or other over the air communication mediums, or it may all be located in one place or device like a CPU. In some embodiments, the control unit 350 may be disposed distantly away from the clasp or the shoe. In other embodiments, the control unit 350 may be disposed in the clasp bands/straps, the clasp, or the shoe upper to which attached the clasp bands/straps. In one embodiment, the control unit 350 may be disposed in the clasp members 113, 114. In another embodiment the control unit 350 may be located on or in a dock (i.e., a dock station) for shoes.

In another embodiment, there may be multiple locations that have control units that communicate with each other, that may be used together with GPS or location tracking devices. Data from these units may be transferred wirelessly to communicate with alarm systems, patient fall notification or emergency medical alert systems, locating kidnap victims, tracking Alzheimer patients who may wander, or finding children who are lost, as some examples.

Figure 5:
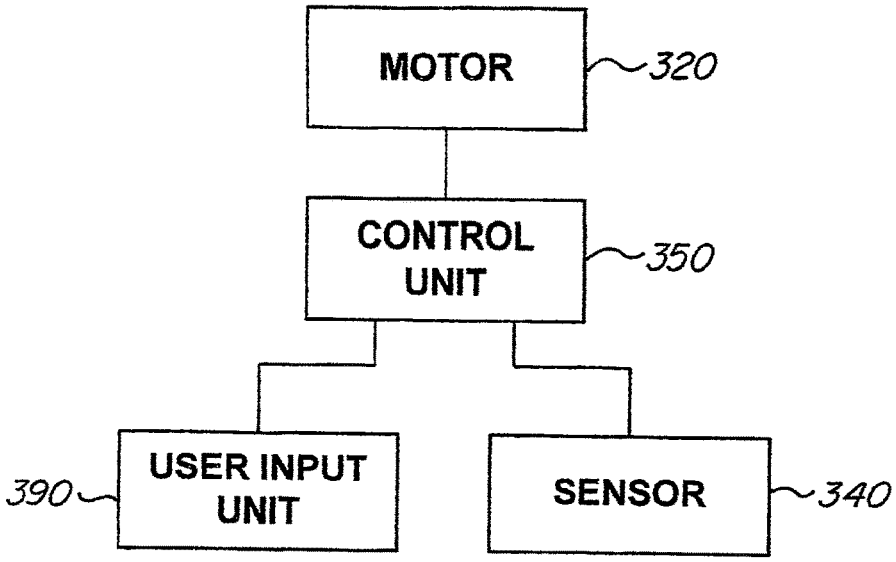
FIG. 5 shows a schematic view of an embodiment having a different mechanism to activate a motor.

In addition to the sensor-triggered activation, activation of the motor 320 may be triggered by a user input. This process may also be called a user-triggered activation. FIG. 5 is a block diagram showing the two types of activation mechanisms. In this diagram, the control unit 350 communicates with the sensors 340, which may trigger activation of the motor 320 through the control unit 350. At the same time, the control unit 350 also communicates with a user input unit 390. Upon receiving a triggering signal from the user input unit 390, the control unit 350 activates the motor 320 in accordance with the user input. The user input unit 390 may be a push button 880 that can be pushed to activate the motor 320. The push button may be located on the back of the shoe heel, such as a push button 880 shown in FIGS. 10A and 10B, which is not shown in FIGS. 1A and 1B.

The push button can be located in any area deemed most easily accessible by the user. In one embodiment the push button controller may have an adhesive or Velcro backing that allows it to be stuck anywhere on the shoe or on any independent surface anywhere that is desirable based on the individuals' mobility habits. It may act as a portable controlling or CPU unit. When pressed it activates the opening and closing mechanisms thru wireless connections to a CPU or control unit. The actual push button device can be stored or housed on or with the general control unit and used with as an integral part of the control unit without placing it in another location. It can also act as a simple override to any of the electronics, whereby pushing the button if it is located in a fixed position on the shoe, manually forces disengagement of the hands free electronics and allows the shoe to be opened manually. Holding the button in the pushed down position may allow the user to continue the tightening electronically until the desired pressure of tightness is achieved without invoking the automatic sensor feedback system described below.

The user input unit 390 may also be an interface on a computer, a handheld remote control, or on a smart watch which allows a user to manually or verbally provide instructions. A user may also set or change a threshold fitting (e.g., tightness) of the shoe by using the interface. The present invention advantageously allows for setting different fitting for different people based on personal preference.

If the activation of the motor 320 is only triggered by the sensors 340, then the adjustment is completely automatic. The activation of the motor 320 may be triggered by the sensors 340 and a user input unit 390 consecutively. The control unit 350 is configured so that, if the control unit 350 receives information from the user input 390 and the sensors 340 simultaneously, the information from the user input unit 390 controls.

Figure 6A:
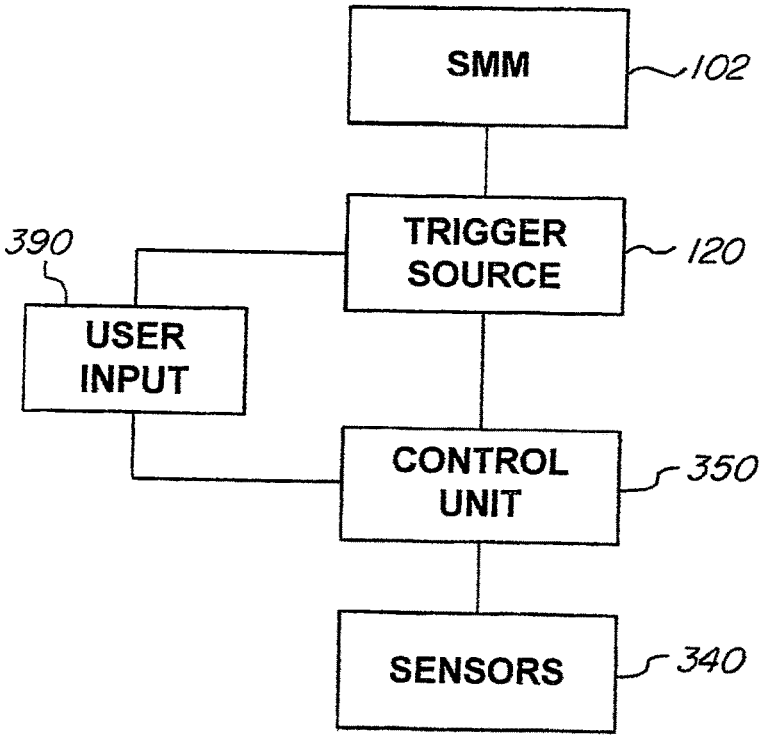
FIG. 6A shows a schematic view of an embodiment having a different mechanism to stimulate a shape memory material.

The control unit 350 may also be in communication with the trigger source 120 to control the activation and deactivation of the trigger source 120. For example, the control unit 350 may instruct the trigger source 120 to send stimulus to the shape memory material or cease stimulation based on sensed information from the sensors 340. The user input unit 390 may be configured to directly control the trigger source 120. FIG. 6A is a block diagram showing the activation mechanism.

According to instructions from the user input unit 390, the trigger source 120 may generate a stimulus to the shape memory materials 102, 102". As discussed before, the user input unit 390 may be in the form of, for example, a switch, a knob, a push button, or a touch screen of a TV. In one embodiment, the user input 390 is a push button located on a shoe, for example, a push button 880 in FIGS. 10A and 10B. After the push button is pushed, the trigger source 120 creates and applies a stimulus (e.g., electric circuit) to the shape memory materials 102, 102", causing the shape memory materials 102, 102" to deform, and the two end portions of the pair of clasp bands/straps 10, 20 to bend and approach one another.

In other embodiments, the user input unit 390 is an interface on a computer, a handheld remote control device, or a smart watch, in which case, the trigger source 120 may receive instructions directly from the touch screen of a computer, a handheld remote control device, a smart watch, or verbally through a "digital assistant" mechanism (e.g. Apple's Sid, Microsoft's Cortana, Google's Google Assistant, Amazon's Alexa) The user input unit 390 may also allow a user to set threshold levels of various sensors. It may further allow a user to select the types and locations of various sensors dispersed in the shoe.

In a preferred embodiment, a remote control unit wirelessly, for example, via a blue tooth device or a smart phone, communicates with the shape memory alloy wires via their stimulus source or actuator, in each of the pair of clasp bands/straps. The remote control unit initiates a first of the pair of clasp bands/straps to bend with its end moving toward the center of the arc of desired motion, and subsequently initiates a second of the pair of clasp bands/straps to bend with the end moving along the same arc of motion so that the two ends are aligned on top of each other with a magnetic piece on each end facing each other before clasping, while compensating automatically for any mal-position that may occur. In these embodiments, the pair of clasp bands/straps are individually constructed, each band comprises its separate shape memory material, separate trigger source, separate sensors, etc.

Figure 6B:
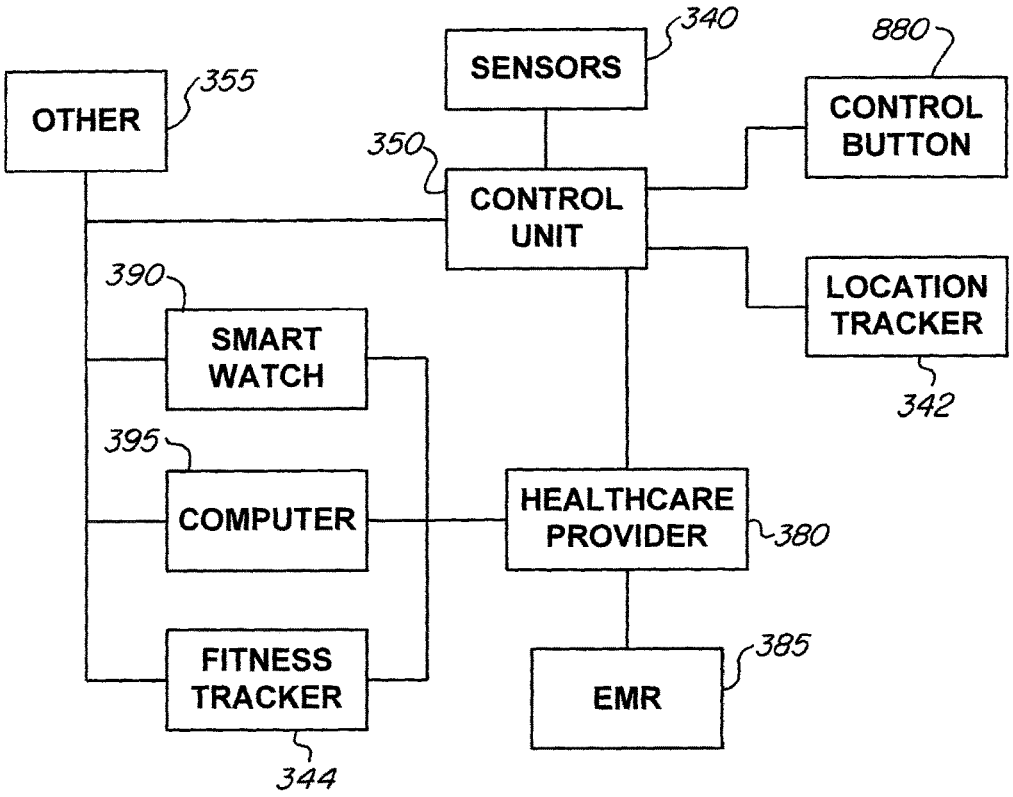
FIG. 6B shows a schematic view of the control unit described in FIGS. 5 and 6A, wherein the control unit gathers and transmits data.
Figure 6C:
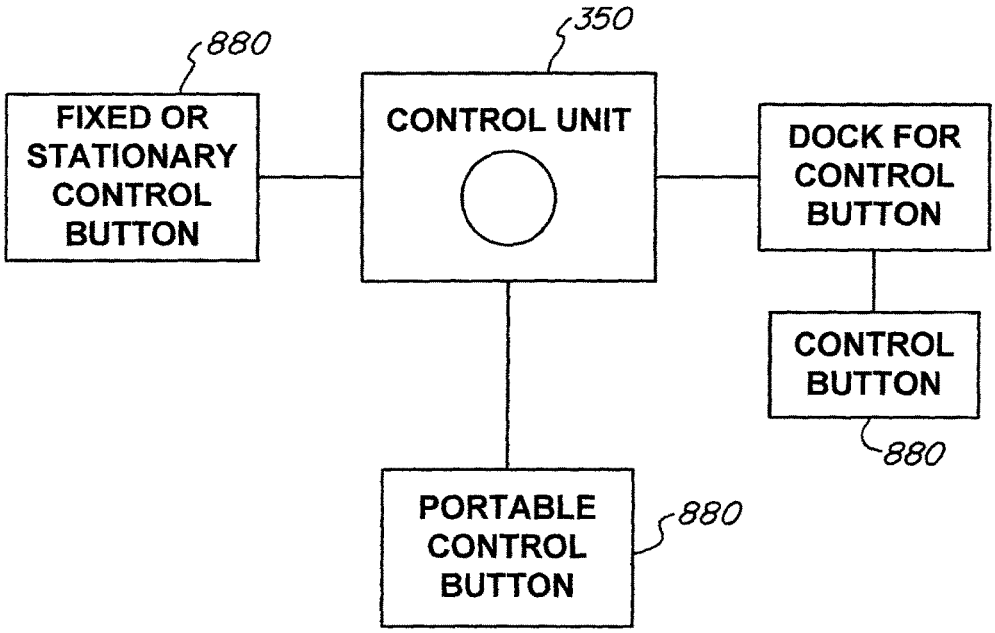
FIG. 6C shows a schematic view of a control button in accordance with the present invention.

In preferred embodiments, the control unit(s) transmits information to Healthcare Providers, EMRs, and fitness tracking devices, as illustrated in the block diagrams of FIGS. 6B and 6C.

FIG. 6B shows that a control unit 350 is in communication with sensors 340. The control unit 350 either transmits the sensed information provided by sensors 340 or processes the sensed information first before transmitting data to a smart watch 390 or a computer 395 for storage or for further processing. The smart watch 390 or the computer 395 in turn may process the sensed information or data received and provide input or instructions to the control unit 350. A button controller (i.e., control button) 880 may also provide a user input or instructions to the control unit 350, and may also serve as an emergency measure—a push of the button would open a closed footwear and release the foot. Moreover, the control unit 350 may transmit sensed, and preferably, processed data directly to healthcare providers 380 regarding a patient who wears the smart footwear of the present invention. The control unit 350 is also in communication with the wearer's healthcare record (EMR) 385, a fitness tracker device 344, a location tracker 342, and other system 355 in order to send this and other types of monitoring information that is derived from monitoring the foot health or other location information of the wearer. The healthcare provider 380 or the wearer, may in turn, provide instructions to the control unit 350 based on the transmitted data or additional needs in order to modify or refine shoe wearing configurations for a particular wearer.

FIG. 6C shows that a control unit 350 has a dock for placing and/or charging a control button 880. The control button 880 may be a portable or stationary device. As a portable device, the control unit 880 may have an adhesive or Velcro backing that allows it to be stuck anywhere deemed most easily accessible by the user. For example, it may be attached to a heel of a sneaker, wall, clothing pocket/fabric, table or other furniture. The control button 880 may be an independent self-contained or powered, automatic, control unit. It may also be used as a manual control only (e.g., pushing the button to actuate a particular control). It may be programmed to provide limited controls or provide all control items/instructions. It may be used as an emergency measure, i.e., to act as a simple override to any of the electronics, whereby pushing the button if it is located in a fixed position on the shoe, manually forces disengagement of the hands free electronics and allows the shoe to be opened manually.

In some embodiments, infra-red or laser beam detection sensor mechanisms, RF sensor mechanisms, or any other sensor mechanism may act as on/off controllers for timing the synchrony of the shape memory alloy's and shape memory polymer's closures with the timing of the magnet locking or matching mechanisms or mechanics of closure timing.

Those skilled in the art understand that the control unit contains additional controls (e.g., safety measures) as necessary to work the invention correctly. Examples of such control would be an alarm/notification, automatic conversion to manual control, or automatic loosening the footwear for safety purposes if the sensors determine it is tightened beyond safe parameters programmed into the control unit. In some embodiments, the push button 880 on a shoe in FIGS. 10A and 10B may also be configured to function as a safety button or a release button. For example, if the shoe fails to automatically enlarge the opening of the shoe to allow taking off the shoe, or if the shoe fails to automatically loosen a very tight fit, a person may press the release button to loosen the shoe and allow the shoe to be taken off.

Motors suitable for use in the present invention may be any type, including, but not limited to, an electric motor, an electrostatic motor, a pneumatic motor, a hydraulic motor, a fuel powered motor. In a preferred embodiment, the motor is an electric motor that transforms electrical energy into mechanical energy. Additionally, the motor should be small enough to be housed in a clasp member. It is also preferred that the motor can complete the tensioning or fine tuning quickly upon receiving instructional triggering signals. For example, in some embodiments, it takes the motor 320 as short as 1-2 seconds to increase or decrease a relative position by approximately +/−6 mm to achieve a fine tuning. Commonly known electric motors such as a lead screw actuator, a worm-gear type motor, or a rack and pinion motor, ratcheting motor, hydraulic, pneumatic or other types of motors may be used in the present invention.

By using sensors to acquire information and trigger the activation and/or deactivation of the motor in order to fine tune the tightness of the clasp band/strap as needed, the present invention advantageously provides a clasp band/strap that not only can close by self-assembly but also can automatically adjust and substantially maintain a preferred tightness thereof during wearing.

The footwear 500 may further comprise at least one power source to supply power to the motor 320, and optionally also supply power to the control unit 350, the trigger source 120, and the sensors 340. In some embodiments, the motor 320 may be associated with a battery 360, as shown in FIGS. 2A and 2B. The battery 360 may also be housed in the footwear. The battery may be any type, shape, or form of battery. It may be a disposable battery or a rechargeable battery. The control unit contains a program to notify the user of need to replace a disposable battery or to charge the rechargeable battery. In some embodiments, the battery is rechargeable.

While FIGS. 2A and 2B show examples of a single clasp band/strap housing many components (e.g., a motor, a control unit, a battery, and sensors), a skilled artisan will understand that those components may be housed in different places. For example, the motor and sensors may be placed anywhere in the footwear; the control unit may be placed in the footwear or away from the footwear. Moreover, a skilled artisan will understand that the present invention also encompasses two motors and/or two controllers to provide multiple independently controlled actuations (not shown).

Figure 7:
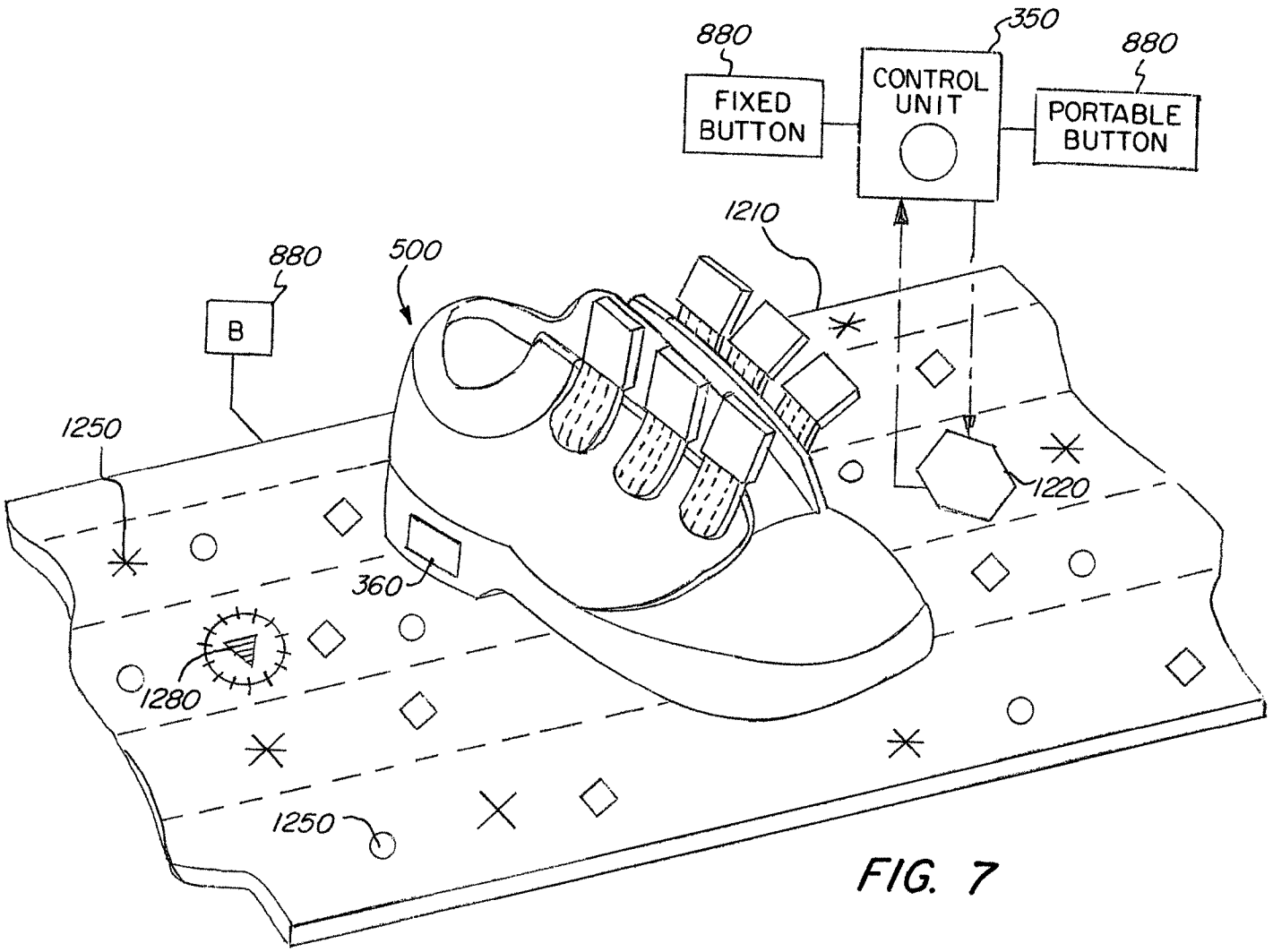
FIG. 7 is isometric and schematic views of a footwear placed in a charging dock station according to one embodiment of the invention.

In preferred embodiments, the batteries 360 inside the footwear 500 may be recharged by directly putting the footwear 500 on or in a charge dock station 1210, as shown in FIG. 7. A footwear 500 may include one or more batteries. The batteries 360 may be recharged without being first taken out of the footwear 500. The dock station 1210 of the present invention may be in the form of a flat mat, or in the form of shoe racks. It may be configured to fit inside the shoe like a "shoe tree" as commonly used to put inside shoes when not worn to maintain their shape (this may not be a hands free application). The dock station 1210 is not only for recharging, but can also be configured to provide a high-powered energy to make recharge happen efficiently or to meet needs of the self-assembly mechanism. Over air charging of the shoes instead of plug in charge is an option. In addition to charging function, the dock device 1210 may have some sensors 1250 to determine whether the shoes have been engaged for rest (i.e., charging mode) and have been active (i.e., worn by a wearer).

The docking system 1210 may also have radar, lidar, ultrasound, infra-red, laser, camera or other sensors 1280 or mechanisms 1220 to detect that a shoe is approaching the docking device 1210 to activate the charging mechanism as an alternative to direct contact with the receiving portion of the dock as the on/off switch. FIG. 7 also shows that there are numerous portable or fixed button controllers 880. The portable button controllers 880 may be placed on the surfaces of wall and table, etc. The button controllers 880, either fixed or portable, may be in communication with a central control unit 350, which in turn communicates with sensors or applicable mechanisms 1220, 1250, 1280. The functions of the button controllers have been described in FIG. 6C and will not be repeated.

Because the footwear of the present invention not only can adjust the initial fitting upon closure, but also can automatically adjust the fitting of a footwear during wearing, people with diabetic feet, or peripheral lower extremity edema and swelling problems, or arthritic feet will particularly be benefited from wearing this type of self-adjusting and self-fitting shoes.

Figure 8A:
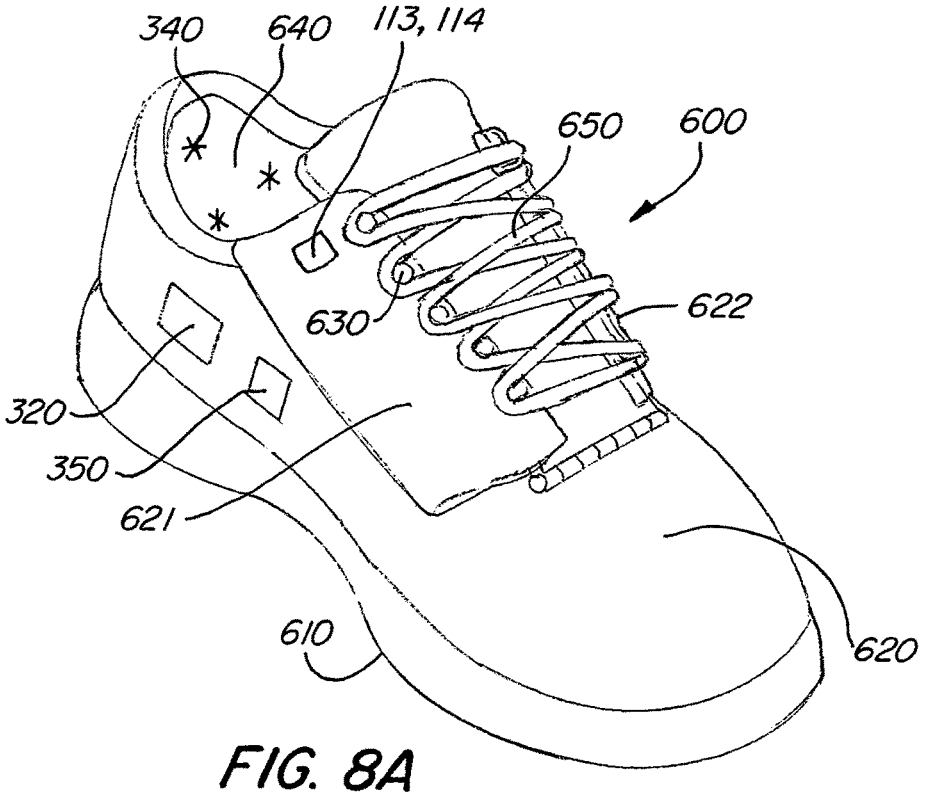
FIG. 8A is an isometric and schematic view of an embodiment of a footwear having a shoelace in a closed position.

FIG. 8A illustrates a cross section view and a longitudinal view of a footwear 600 in according to the present invention. The footwear 600 has the same structure as the footwear 500 in FIGS. 1A and 1B, except that the footwear 600 utilizes a lace system, instead of the clasp bands. A shoelace 650 in this embodiment comprises a shape memory material (e.g., nitinol) (as shown in FIGS. 8C and 8D), preferably in the form of wires. The footwear 600 comprises a sole 610 and an upper 620. The upper 620 comprises lateral and medial portions 621, 622 with studs or anchors 630 disposed on the lateral and the medial portions 621, 622 on top of the shoe tongue area (not shown), near the opening 640 of the footwear.

The shoelace 650 is in a loop configuration that falls over and then down onto opposing studs, bolts, or anchors 630 on the other side upon which it tightens across the foot when stimulated. The shoelace 650 may also comprise conventional wires. Nitinol wire and conventional wires may be braided together and run throughout the lace. Flexible electronic circuitry 660 could also be made to run through the central core of the shoelace 650 to provide stimulation. The shoelace 650 may also use stretchable electronics or stretchable wires. The electric circuitry 660 is in communication with a trigger source (not shown). The lace can be routed through channels in the clasp and act as the equivalent of the band/strap described in other embodiments.

Figure 8B:
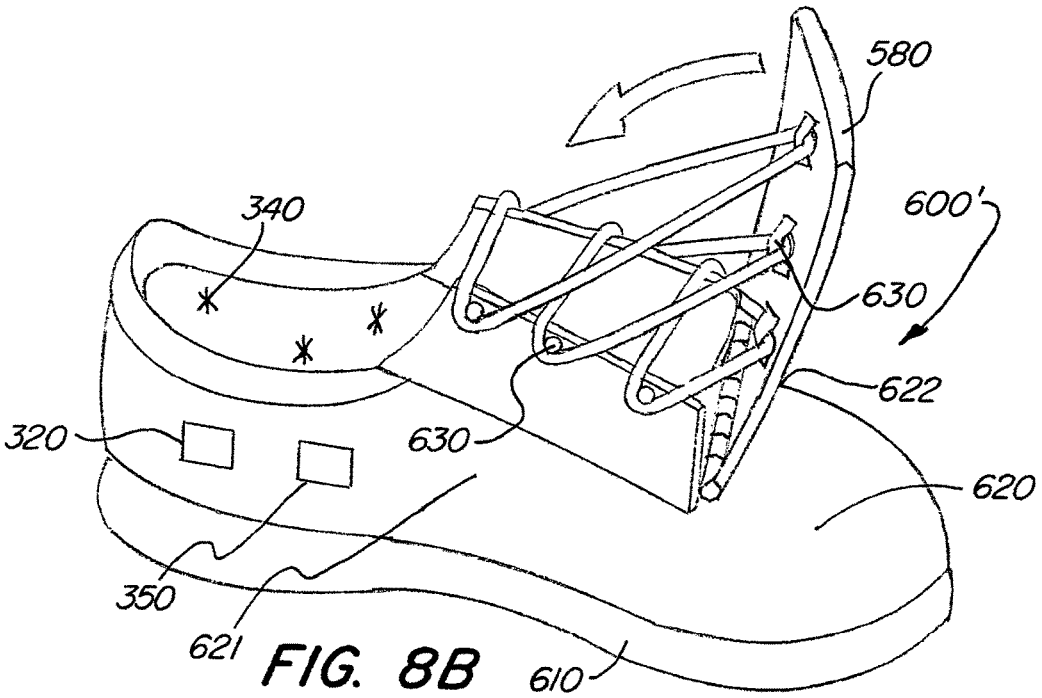
FIG. 8B is an isometric and schematic view of another embodiment of a footwear having a shoelace engaged with a shoe tongue and shoe upper portions in an open position.
Figure 8C:
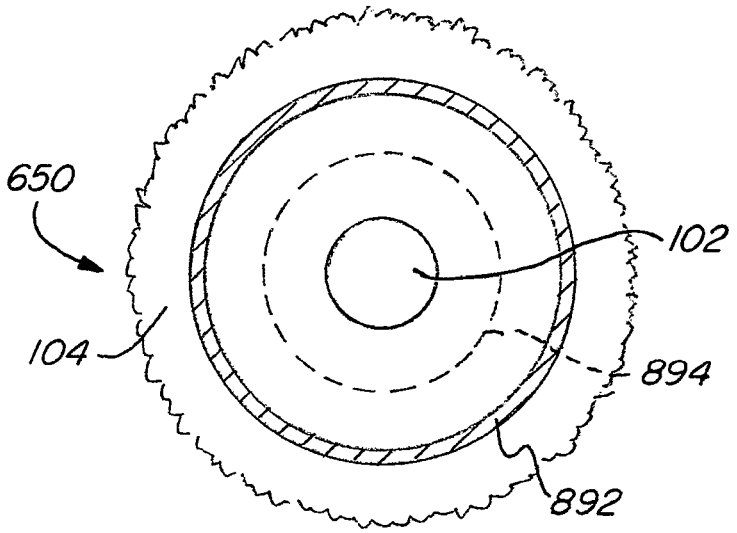
FIG. 8C shows an enlarged cross sectional view of the shoelace of FIGS. 8A and 8B.
Figure 8D:
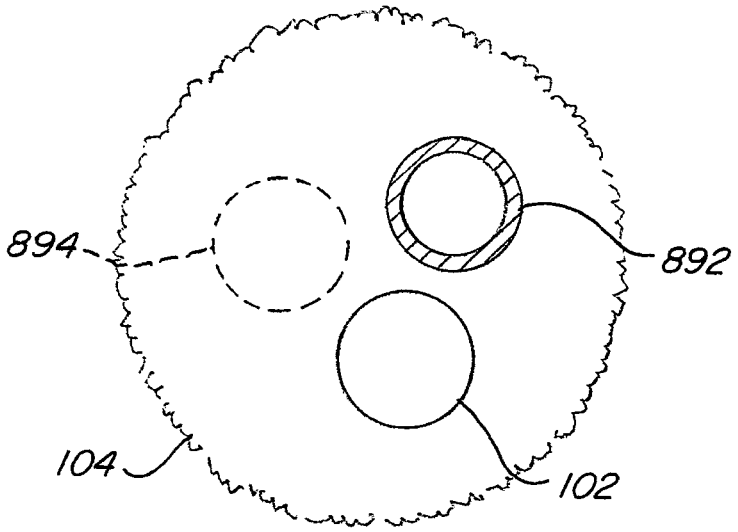
FIG. 8D shows an enlarged cross sectional view of the shoelace with the organization of the components in a different configuration than that in FIG. 8C.

FIG. 8B illustrates another embodiment of the footwear 600 utilizing a self-assemble shoelace system. In this embodiment, the footwear 600 comprises a tongue 580 in addition to a sole 610 and lateral and medial portions 621, 622 of an upper 620. Studs/bolts/anchors 630 are disposed on the lateral and the medial portions 621, 622 as well as on the shoe tongue 580. A shoelace 650 comprising at least one shape memory material 120 is in a loop configuration that falls over one of the studs/bolts/anchors 630 on the tongue 580, and then down to another one of the studs/bolts/anchors 630 on either the lateral or the medial portion 621, 622, such that the shoelace 650 weaves through the lateral portion, the tongue, and the medial portion. Upon stimulation, the shape memory material 120 deforms and brings the lateral portion, the tongue, and the medial portion together for closure.

The shoes in FIGS. 8A and 8B work essentially the same except that the shoe in FIG. 8A brings two parts (the lateral and medial parts) together for shoe closure, while the shoe in FIG. 8B brings three parts (the lateral and medial parts, and the tongue) together for closure. The following descriptions regarding shape memory materials, clasp members, motors, control units, etc. are applicable to both embodiments in FIGS. 8A and 8B.

More than one set of nitinol loops may be interspersed in the upper so that one set is activated work to close the upper and the other set is positioned and programmed to work in the opposite direction to open the upper. The nitinol loops can also be positioned so as to overlap one another in order to get sequential closing of the loops that in additive fashion will allow for the large distances and radius's to conform to the amount of closure one nitinol loop can achieve on its own, e.g. one loop is positioned with another loop positioned right next to it but half way closer to the end clasp, and repeated several times over the distance that is required for complete closure.

At end of the nitinol loop 102 where the lateral, medial, and tongue portions would meet at a closed shoe position, at least one pair of clasp members 113, 114 are coupled to the lateral, medial, and/or tongue portions 621, 622, 580. The phase transformation of the nitinol loop 102 will bring the two lateral and medial portions 621, 622, or the three portions (the lateral, medial, and tongue portions 621, 622, 580) close to each other, causing the matching clasp members 113, 114 to clasp, which further secures the closure.

While the footwear 600 is described by using nitinol as an example, a person of ordinary skill in the art would understand that other shape memory material or a blend of shape memory materials may be used.

The choices, components, and functions of the shape memory material, the triggering source, and the clasp used in this and other embodiments to be discussed in the application are the same or substantially the same as the shape memory material discussed earlier in this application. Therefore, detailed information concerning the shape memory material and the clasp will not be repeated. Preferably, the clasp is magnetic clasp, SMM containing lace or a combination of the unique lace and magnetic clasp. When the shape memory material is nitinol, a preferred triggering source is electric current. More preferably, the shape memory material comprises two or more shape memory alloys/polymers that provide counteracting actuations in two directions.

The footwear 600 may also be tightened through a motor mechanism, just like the footwear 500 described before. Referring back to FIG. 8A, the footwear 600 may further comprise at least one motor 320 disposed anywhere in the footwear for fine tuning the fitting of the footwear by adjusting the relative position of the clasp members 113, 114 with respect to the shoelace 650. The footwear 600 may further comprise sensors 340 and a control unit 350. The sensors 340 are configured to acquire information related to the footwear and send sensed or acquired information (e.g., measurements) to the control unit 350. The control unit 350 in turn controls the activation and cease of the activation of the motor 320. The motor 320 may be powered by a rechargeable battery, in which case, a charge station may be provided to receive the footwear for charging the battery therein. A user input may be utilized to provide instructions to the motor, the trigger source, and the control unit.

Such a lace tightening mechanism/motor is able to work in reverse to allow the lace loop to elongate and then disengage from the anchor post. Similarly the motor mechanism may include a ratchet or other unlocking device that separates or disengages the magnets automatically without having to use hands to initially pull the magnets apart.

The motor, the sensors, the control unit, and the user input used in these and other embodiments to be discussed in the application are the same or substantially the same as what have been used in the previous embodiments. Thus, detailed information concerning these parts will not be repeated.

In some embodiments, a push button (not shown) may be located on the back of the shoe heel for manually opening up the shoe for foot release (not shown). The push button may also be configured to activate self-assembly. The push button may be portable with ability to be fixed to any surface and may act as a surrogate control unit either independent of or connected to the main control unit, as described previously.

FIG. 8C shows a cross-section view of a shoelace according to one embodiment of the invention. The shoelace 650 comprises a conventional shoelace fabric or other material 104 and nitinol wires 102. The shoelace 650 may comprise a cable 892 for tightening or loosening the shoelace and a flexible circuitry, which may also be stretchable electronics 894. In the embodiment illustrated in FIG. 8C, the cable 892 encircles the electronics 894, which in turn, further encircles the nitinol wires 102. The relative positions of the cable, electronics, and nitinol within the shoelace structure may be in any configuration in any order or layer, e.g. they do not have to encircle each other but may be located separately and next to each other, as shown in FIG. 8D. The lengths and orientation of the wires 102, the cable 892, and the electronics 894 conform to the desired shape of the shoelace 650. The shoelace does not need all three components together to function. The term cable implies a separate layer within the assembly, when in fact it may refer to robust fabrics currently used to tie shoelaces under tension, as the external or surrounding layer of the assembly without any internal cable needed.

Figure 8E:
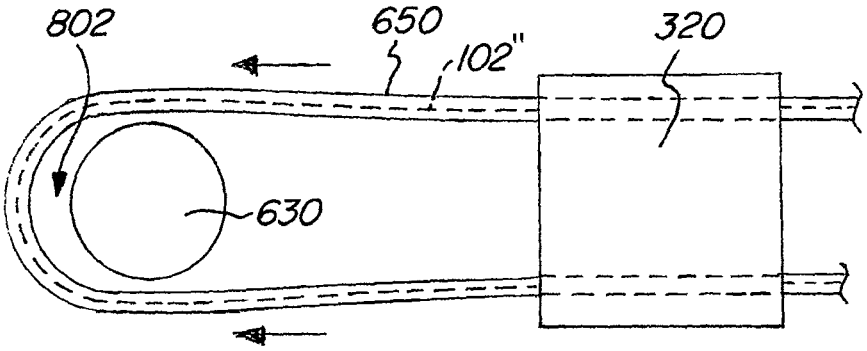
FIG. 8E shows a schematic view of a shoelace, motor, and post/stud assembly overlapped or engaged with each other but not in a tightened position.
Figure 8F:
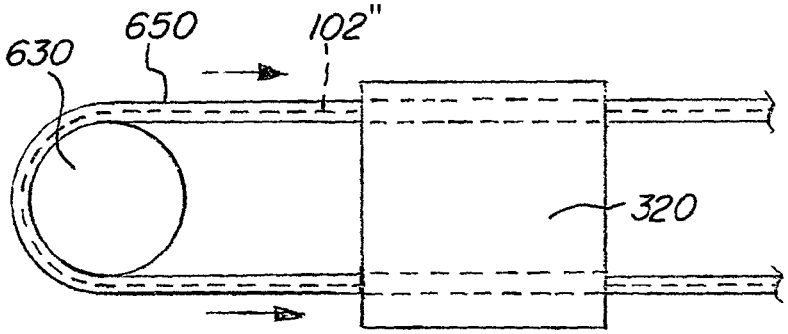
FIG. 8F shows the tightened position of the shoelace, motor, and post/stud assembly of FIG. 8E.

FIGS. 8E and 8F illustrates a motor-actuated shoelace self-assembly system in non-tightened and tightened configurations. In FIG. 8E, the shoelace 650, which comprises the nitinol wires 102", the cable, and the electronics, is loosely looped onto a post/stud 630, as shown by a gap 802 between the end of the post/stud 630 and the lace 650 surrounding it. Upon stimulation of the nitinol wires 102", the shoelace 650 deforms which positions and may tighten the shoelace 650 around the post/stud 630. The gap 802 disappears, as shown in FIG. 8F. A motor 320-actuated tensioning further tightens the shoelace 650 around the post/stud 630 and around a foot (not shown).

Figure 8G:
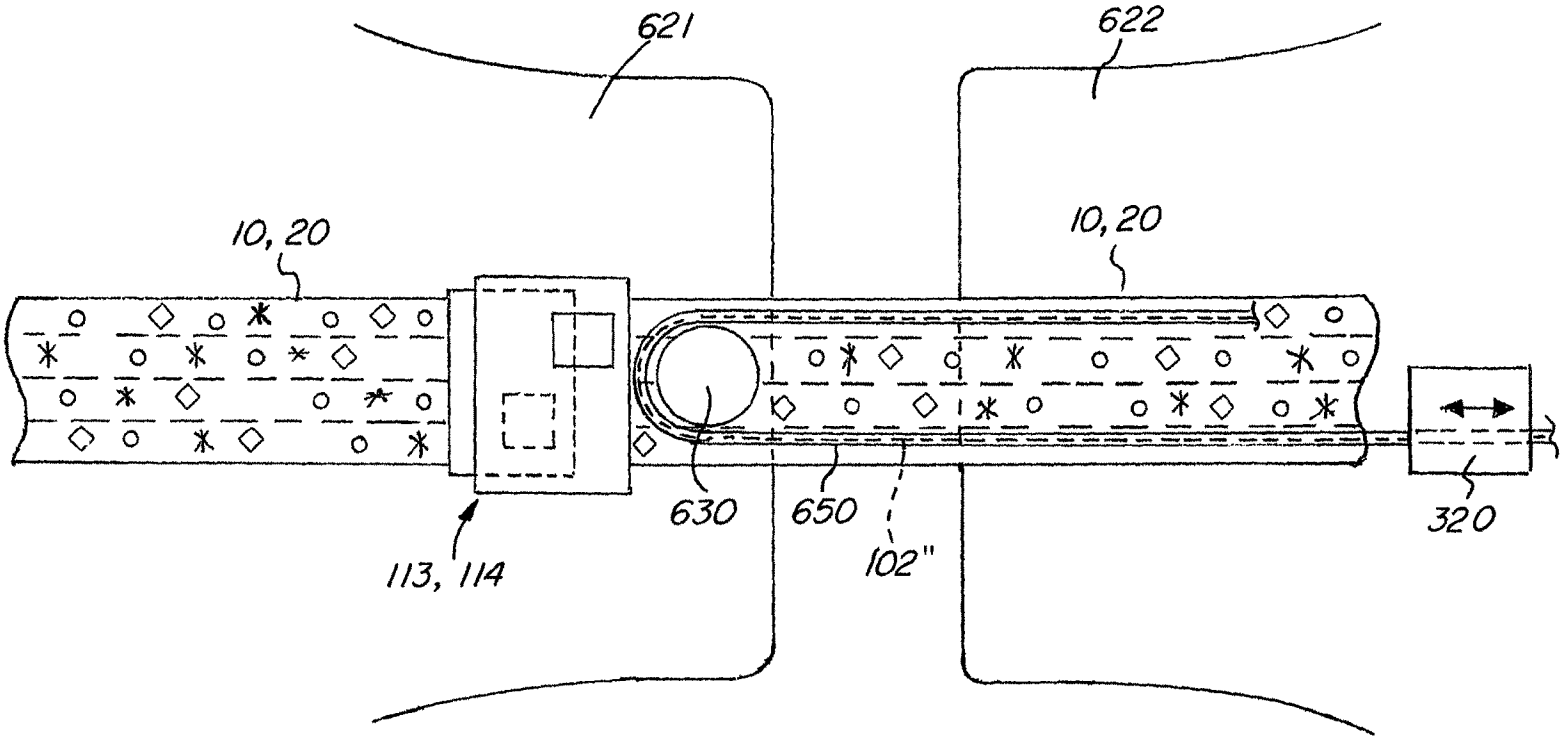
FIG. 8G shows an isometric and schematic view of another footwear which utilizes a lace and clasp/band-strap, and a motor combination for closing and opening the footwear.

FIG. 8G illustrates a motor-actuated shoelace and clasp strap/band combo self-assembly system. A pair of matching clasp straps/bands 10, 20 are attached to two upper parts 621, 662 of a footwear 600 facing each other. Each of the clasp straps/bands 10, 20 comprises a clasp member 113 or 114 and a SMM. One of the upper parts 621 has an anchor/stud/post 630. The other upper part 622 is attached to a shoelace 650, which is in communication with a motor 320. The shoelace 650 comprises the same or a different SMM than the SMM in the clasp bands/straps is looped around the anchor/stud/post 630.

Upon stimulation, the SMM 102" deforms, which brings the two clasp straps 10, 20, as well as the two upper parts 621, 622, closer to each other. The matching clasp members 113, 114, now in a closer position, clasp, and thus connect the two upper parts 621, 622. The SMM 102" in the shoelace 650 is also stimulated (the two stimulations of the SMMs may be in sequence or simultaneously), which further helps to position the shoelace correctly around the post/stud. It may also lead to the initial tightening of the shoelace 650 around the post/stud/anchor 630 and the foot (not shown). The cable portion of the lace provides the strength to allow for the true tightening or adjustment. The material or fabric of the outermost layer of the shoelace assembly may be robust enough to be pulled by the motor for tightening, thus eliminating the need for a cable. The motor 320 then fine-tunes the tightness of the shoelace 650 around the foot (not shown) to complete the initial self-assembly and self-fitting of the footwear.

As shown in FIG. 8G, a gap 802 is formed between the end of the post/stud 630 and the lace 650. Upon stimulation of the nitinol wires 102", the shoelace 650 contracts which to help to position the shoelace around the post/stud and may help in the initial tightening of the shoelace 650 around the post/stud 630. The gap 802 disappears as motor 320-actuated tensioning further tightens the shoelace 650 around the post/stud 630 and also around a foot (not shown).

Figure 9A:
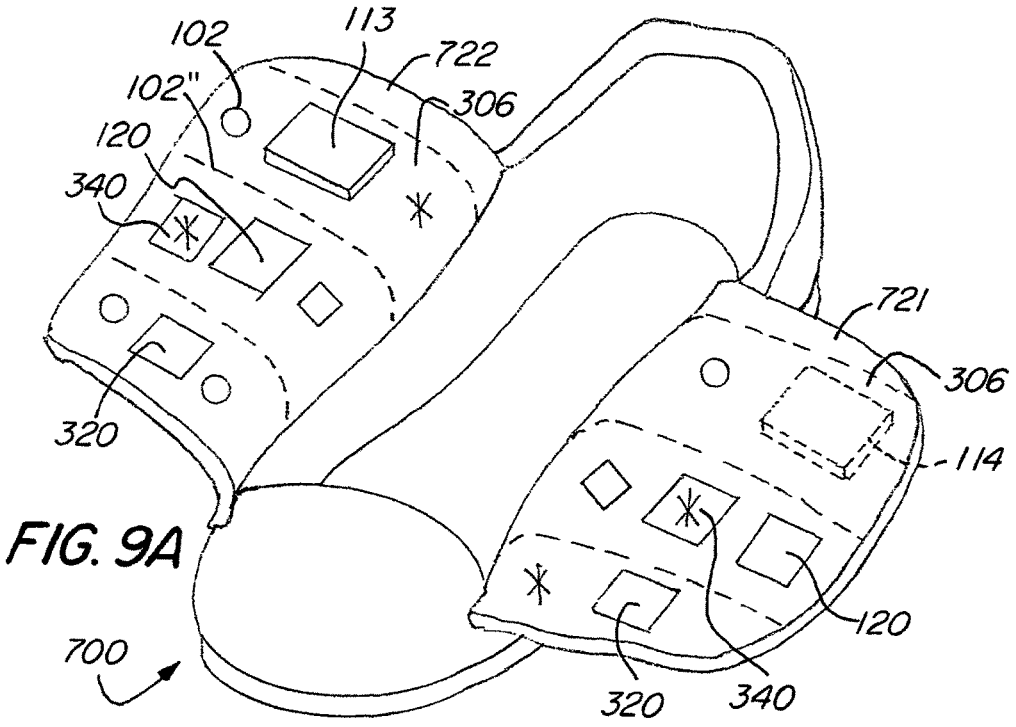
FIGS. 9A and 9B are isometric and schematic views of a further embodiment of a footwear with upper portions having shape memory material disposed on large areas of the upper portions, in an open position and a closed position.
Figure 9B:
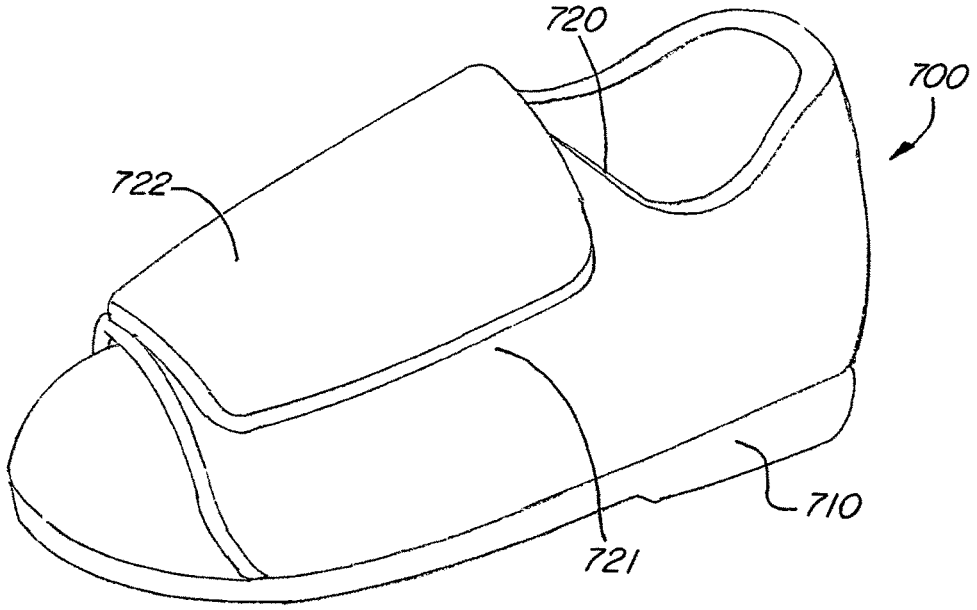

FIGS. 9A and 9B illustrate a footwear 700 having a shoe sole 710 and a shoe upper 720. The shoe upper 720 comprises a first flap 721 and a second flap 722, which may be separable from each other and splayed wide open, as shown in FIG. 9A. When in use, the flaps 721, 722 are stacked on top of one another and closed around a foot, as shown in FIG. 9B.

Each of the flaps 721, 722 has a mesh layer 306 on which shape memory materials 102, 102" and a non-shape memory material are deposited. Alternatively, the non-shape memory material and the shape memory materials 102, 102" are disposed beneath the mesh layer 306 in the flaps 721, 722. The footwear 700 may include a trigger source 120 in communication with the shape memory materials 102, 102". The footwear 700 may comprise one set of clasp members 113 disposed on the flap 721 and another set of matching clasp members 114 disposed on the flap 722, wherein the matching clasp members 113, 114 are positioned in a way that they would be in contact and clasp when the flaps 721, 722 are stacked up on one another in a closed position.

The trigger source 120 is configured to provide a stimulus to the shape memory materials 102, 102". The flaps 721, 722 are configured to self-assemble into a shape around a foot in response to a trigger received from the trigger source 120. Upon the initial self-assembly, the pairs of the clasp members 113, 114 are brought together and clasp, which encloses the foot in the footwear. The shoe wearing process can be hands free.

The mesh layer 306 may comprise a plastic material, foam material, and/or textile (e.g., fabric) material. Overall, the flaps 721, 722 may be a laminate or "stack up" composite with layers of foam/actuators and/or circuitry/stiffener, or foam/fabrics/actuators/circuitry/spacer/stiffeners.

Preferably, the clasp is magnetic clasp. Preferably, the shape memory material is nitinol and the triggering source is an electric current. More preferably, the shape memory material comprises one or two or more shape memory alloys/polymers that provide counteracting actuations in two directions.

Referring back to FIG. 9A, the footwear 700 may further comprise at least one motor 320 disposed in the footwear for fine-tuning the fitting of the footwear initially and during the courses of wearing. The footwear 700 may further comprise sensors 340 disposed on the interior surfaces of the shoe (including on top of the sole) or beneath the interior surfaces of the shoe. A control unit 350, either in the footwear or remotely away from the footwear, is provided to communicate with the sensors 340 and the at least one motor 320. The sensors 340 are configured to acquire information related to the footwear and send sensed or acquired information (e.g., measurements) to the control unit 350 (not shown, as it does not need to be in the footwear). The control unit 350 in turn controls the activation and cease of the activation of the motor 320. The motor 320 may be powered by a rechargeable battery. A charge station may be used as described before. Moreover, a user input may be utilized to provide instructions to the motor, the trigger source, and the control unit.

Figure 9C:
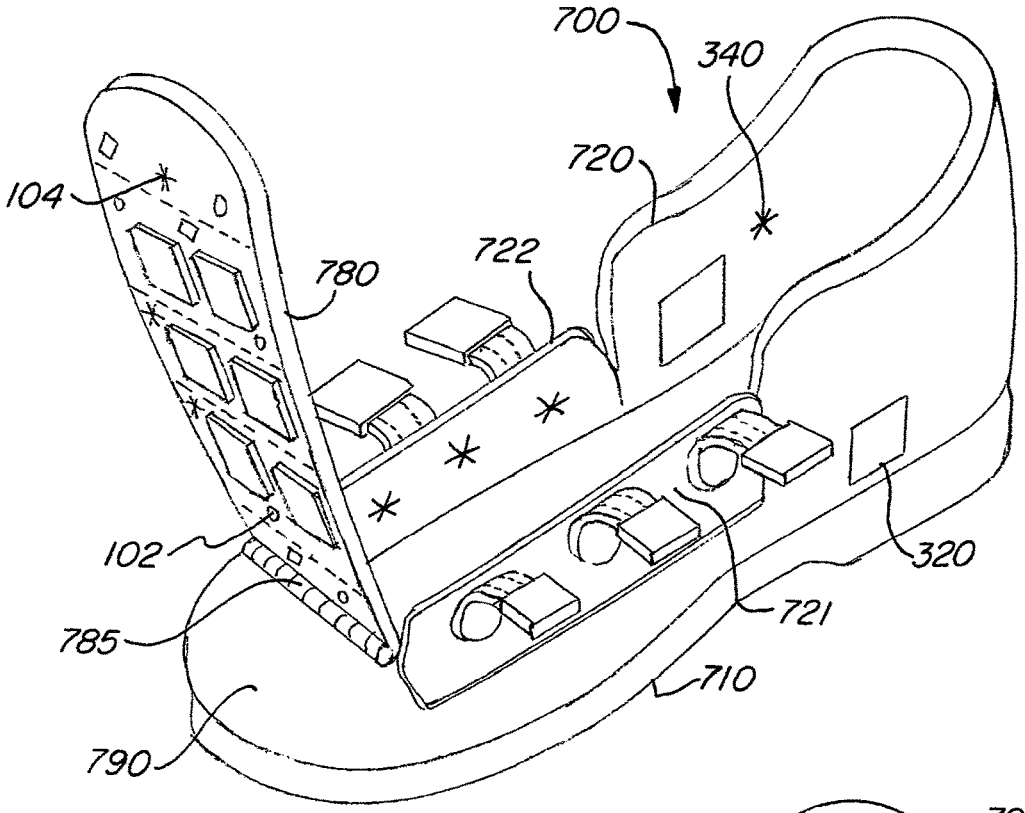
FIGS. 9C and 9D are schematic and isometric views of a footwear with a shoe tongue having shape memory material disposed thereon, in an open position and a closed position.
Figure 9D:
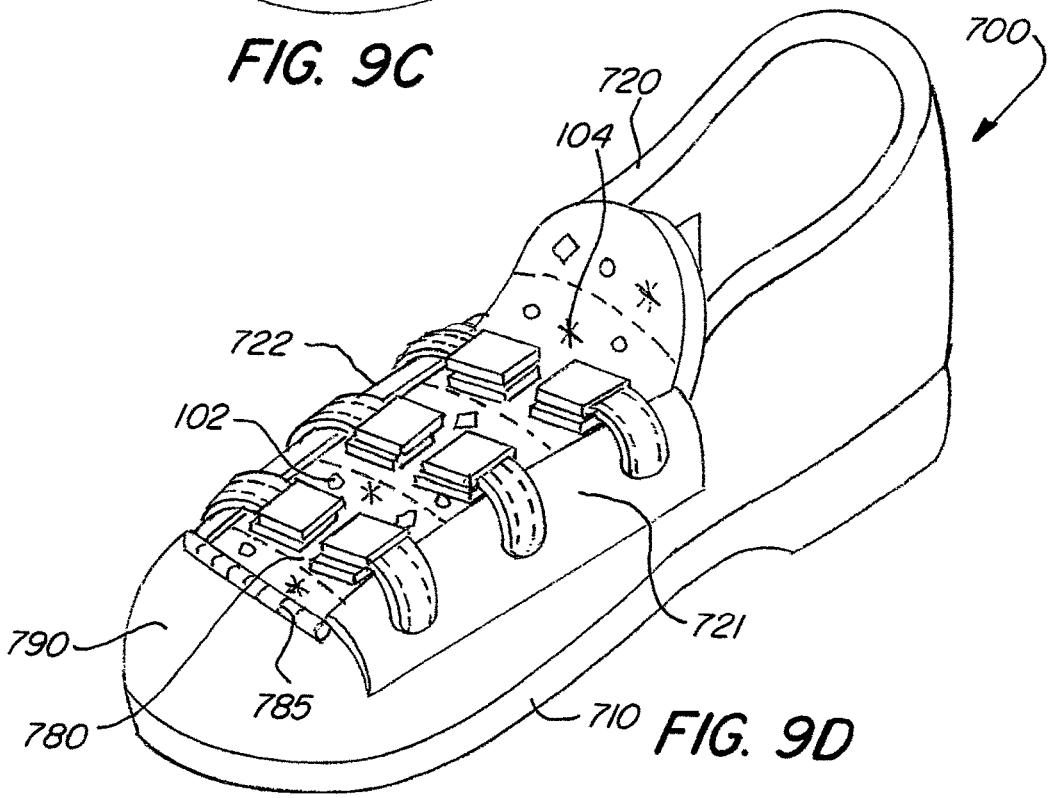

FIG. 9C shows a motorized hinge 785 (or simple manual folding hinge) mechanism connecting the distal portion of a shoe tongue 780 where it attaches to the fixed distal toe box 790. The footwear 700 comprises a sole 710 and an upper 720. The upper 720 comprises a lateral portion 721, a medial portion 722, and the shoe tongue 780. The shoe tongue 780 is attached to the upper 720 by the shoe hinge 785 at a distal end near the toe box 790. The toe box 790, in turn, is affixed to the shoe sole 710. The shoe tongue 780 may be prepared by the same or substantially the same SMM and non-SMM as the two flaps 721, 722 so that the tongue 780 is able to self-assemble around a foot upon receiving a stimulus and may de-assemble upon receiving another signal, just as the flaps 721, 722. A motor may be utilized to facilitate the self-assembly, as will be discussed in detail. In preferred embodiments, clasps, clasp bands/strap or lace assemblies having smart material may be utilized to complete the closure, as previously described. After the assembly, the shoe tongue 780 may be positioned either on top of or underneath the two upper halves 721, 722, or at least overlaps with the two upper halves 721, 722 so as to close the footwear 700 around a foot.

The footwear 700 may further comprise at least one motor 320 disposed in the footwear for fine-tuning the fitting of the footwear initially and during the courses of wearing.

The footwear 700 may further comprise sensors 340 disposed on the interior surfaces of the shoe (including on top of the sole) or beneath the interior surfaces of the shoe. A control unit 350, either in the footwear or remotely away from the footwear, is provided to communicate with the sensors 340 and the at least one motor 320. The sensors 340 are configured to acquire information related to the footwear and send sensed or acquired information (e.g., measurements) to the control unit.

In some embodiments, a push button may be located on the back of the shoe heel of the footwear 700 to manually open the shoe for foot release (not shown). The push button may also be configured to activate self-assembly.

FIG. 10A shows another embodiment of a self-assemble footwear according to the present invention. A footwear 800 has a shoe sole 810 and a shoe upper 820. The shoe upper 820 comprises a lateral portion 821, a medial portion 822, a heel portion 830, and an opening 840 for receiving or removal a foot. The heel portion 830 is pivotally connected to the lateral and medial portions 821, 822 but is fixedly attached to the shoe sole 810. A cable 890 is coupled to the first lateral portion 850 (a starting point), passes through the heel portion 830, and coupled to the second lateral portion 860 (an ending point) so as to connect these portions and form a loop, as shown in FIG. 9A. The cable 890 is positioned near top of the shoe and substantially parallel to the sole. With this configuration, the shoe opening 840 is enlarged to receive a foot, as shown in FIG. 9A. The maximum size of the shoe opening 840 is determined by the length and position of the cable 890.

Instead of using a single cable connecting the three portions, two cables may be used, one to connect the lateral potion 821 and a position on the heel portion 830, and one to connect the medial portion 822 and another position on the heel portion 830. Alternatively, the single continuous cable may loop around the lateral portion, the heel portion, and the medial potion to form a full circle. The cable may be inserted between the interior and outer surfaces of the upper to the extent possible so that it will not show. Moreover, the cable may further connect to the shoelace 650, as shown in FIGS. 8A and 8B to form a one long piece cable/lace. The term cable includes robust fabrics, plastics or metals.

The cable 890 comprises a shape memory material 102", preferably in the form of wire or string. (See FIG. 10C). Because the shape memory material 102" is able to transition between a memorized shape and a temporary shape of the shape memory material upon receipt of a stimulus, the cable 890 deforms upon stimulation, thereby pulling the heel portion 830 closer to the lateral and medial portions 821, 822 and self-assembling the footwear 800 around a foot to close the shoe, as illustrated in FIG. 10B.

Preferably, the cable 890 comprises more than one shape memory materials which may provide counteracting actuations in two directions so as to pull together or opening up the shoe from a closed position (FIG. 10B) to an open position (FIG. 10A). The shoe 800 also comprises a trigger source 120 in communication with the shape memory material 102. The trigger source 120 is configured to provide a stimulus to the shape memory material 102", 102". A preferred memory shape material is nitinol in the form of wires.

In preferred embodiments, the footwear 800 may comprise clasp members 113 disposed on the lateral and medial portions 821, 822 and the matching clasp members 114 disposed on the heel portion 830 at where the heel portion is in contact with the lateral and medial portions when the footwear is in a closed position, respectively. Upon stimulation (e.g., upon sensing a foot is placed into the shoe), the shape memory material inside the cable 890 deforms and pulls the heel portion 830 towards the lateral and medial portions 821, 822, which in turn brings the pairs of the clasp members 113, 114 together to clasp. The entire process is self-assemble, hands-free. Preferably, the clasp members 113, 114 are magnetic clap members and the clasp members are attracted to each other by a magnetic force.

In some preferred embodiments of the invention, the footwear 800 may further comprise at least one motor 320 disposed on one of the clasp members (e.g., 113, 114) for fine-tuning the tightness of the clasp bands/straps initially and during the courses of use. The footwear 800 may further comprise sensors 340 and a control unit 350 which is in communication with the sensors 340 and the at least one motor 320. The sensors 340 may be dispersed on or in the sole and/or other interior surfaces of the shoe. The sensors 340 are configured to acquire information related to the footwear 800 and send sensed or acquired information (e.g., measurements) to the control unit 350. Based on the information received from the sensors 340, the control unit 350 may determine whether the motor 320 needs to be activated to loosen or tighten the clasp bands/straps 10, 20 and if so, the particular movement to be carried out by the motor 320 to reach the desired effect. The control unit 350 then sends triggering signals to the motors 320 to activate that movement. The movement of the motor 320 changes the relative position of the clasp members 113, 114 with respect to the other part of the shoe, thereby fine tuning the tightness of the shoe immediately upon closure and also during wearing. A disposable or rechargeable battery may be provided to supply powers to at least one motor, sensors, etc. A charge dock station may be used to rest the footwear 800 and to charge the battery therein.

In some embodiments, a push button is provided on the back of the shoe heel for manually open up the shoe for foot release (not shown). The push button may also be configured to activate self-assembly.

The components shown in FIGS. 10A and 10B which have been discussed before will not be discussed again.

While the present teachings have been described above in terms of specific embodiments, it is to be understood that they are not limited to those disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. Footwear comprising:

a shoe sole, and a shoe upper having a first flap and a second flap, shape memory materials disposed on at least one of the first flap and the second flap;

at least one pair of clasp members attached to the first and the second flaps with at least one clasp member on each of the first and the second flaps, a trigger source in communication with the shape memory material, the trigger source being configured to provide a stimulus to the shape memory material, wherein the at least one of the first and the second flaps having the shape memory materials is configured to transition between a memorized shape and a temporary shape around a foot in response to a stimulus from the trigger source, thereby bringing the at least one pair of clasp members closer to one another, and thereby facilitating the clasp of the at least one pair of clasp members, wherein the transition between a memorized shape and a temporary shape is configured such that the at least one of the first and the second flaps is adapted to affix around the foot in a fixed manner, and wherein the clasp of the at least one pair of clasp members configured to close the shoe upper about the foot, wherein the shape memory material comprises two shape memory materials, wherein the two shape memory materials provide counteracting actuation such that a first shape memory material is configured to shape transition in a first direction in response to a first stimulus and a second shape memory material is configured to shape transition in a second direction in response to a second stimulus simultaneously, the second direction being opposite the first direction.

2. The footwear of claim 1, wherein the at least one pair of clasp members comprise a pair of magnetic pieces with one magnetic piece on each clasp member, wherein the two magnetic pieces are mutually attracted to each other over a space, such that the clasp members clasp to form an overlap.

3. The footwear of claim 1, wherein the shoe upper further comprises a shoe tongue, wherein shape memory materials disposed on the shoe tongue enable the shoe tongue to transition between a memorized shape and a temporary shape when the shape memory materials receive stimulation.

4. The footwear of claim 3, wherein at least two clasp members are disposed on the shoe tongue, and wherein one of the at least two clasp members on the shoe tongue is configured to clasp with one matching clasp member on a lateral portion of the shoe upper and another of the at least two clasp members on the shoe tongue is configured to clasp with another matching clasp member on a medial portion of the shoe upper to close the shoe upper.

5. The footwear of claim 3, wherein the shoe tongue is attached to a toe box of the footwear by a shoe hinge, wherein the shoe hinge is in communication with a motor; and wherein the motor is configured to tighten or loosen a fitting of the footwear.

6. Footwear comprising:

a shoe sole, and a shoe upper having a first flap and a second flap, shape memory materials disposed on at least one of the first flap and the second flap;

at least one pair of clasp members attached to the first and the second flaps with at least one clasp member on each of the first and the second flaps, a trigger source in communication with the shape memory material, the trigger source being configured to provide a stimulus to the shape memory material, a motor disposed in the footwear, the motor being configured to adjust a position of the at least one pair of clasp members with respect to one of the first and second flaps in order to tighten or loosen the footwear, sensors disposed on or beneath interior surfaces of the footwear, and a control unit in communication with the motor, the sensors, and the trigger source, wherein the at least one of the first and the second flaps having the shape memory materials is configured to transition between a memorized shape and a temporary shape around a foot in response to a stimulus from the trigger source, thereby bringing the at least one pair of clasp members closer to one another, and thereby facilitating the clasp of the at least one pair of clasp members;

wherein the transition between a memorized shape and a temporary shape is configured such that the at least one of the first and the second flaps is adapted to affix around the foot in a fixed manner;

wherein the clasp of the at least one pair of clasp members configured to close the shoe upper about the foot;

wherein the control unit is configured to instruct the trigger source to send a stimulus to the shape memory material; and wherein the control unit is configured to control activation and deactivation of the motor based on measurements provided by the sensors.

7. The footwear of claim 6, further comprising a user input unit in communication with the trigger source and the control unit, wherein the control unit is configured to control activation of the motor in response to instructions provided by the user input unit, and wherein the trigger source is configured to send a stimulus to the shape memory material in response to instructions provided by a user input unit.

8. The footwear of claim 6, wherein the control unit is in communication with at least one of a wearer's healthcare record, a database, a fitness device, a device containing a mini-computer, and a computer; and wherein the control unit is configured to provide foot health information of the wearer to a health provider or to the database.

9. The footwear of claim 6, wherein the control unit is configured to detect geographical position of the footwear; wherein the control unit is configured to send the geographical position information to a database or to an alarm device.

10. The footwear of claim 6, further comprising:

a push button positioned on the heel portion of the shoe upper, wherein the push button is configured to loosen a closed footwear upon a push on the push button so as to open the footwear and release a foot.

11. Footwear comprising:

a shoe sole, and a shoe upper having a heel portion, a lateral portion, and a medial portion, wherein a gap exists between the lateral and medial portions, a plurality of clasp straps attached to the lateral and medial portions, a plurality of clasps, each of the plurality of clasps having two clasp members, wherein each of the plurality of clasp straps attaches to one of the clasp members, a shape memory material disposed in the plurality of clasp straps, a trigger source in communication with the shape memory material, wherein the trigger source is configured to provide a stimulus to the shape memory material, wherein the shape memory material is configured to transition between a temporary shape and a memorized shape automatically upon receipt of a stimulus, and wherein the transition of the shape memory material causes the two ends of the plurality of clasp straps to move towards to each other, thereby facilitating the clasp of the two clasp members and the closing of the gap between the lateral and medial portions, wherein the shape memory material comprises two shape memory materials, and wherein the two shape memory materials provide counteracting actuation such that a first shape memory material is configured to shape transition in a first direction in response to a first stimulus and a second shape memory material is configured to shape transition in a second direction in response to a second stimulus simultaneously, the second direction being opposite the first direction.

12. The footwear of claim 11, wherein the footwear comprises a shoe tongue, wherein the shoe tongue closes the gap when the footwear is in a closed position, and wherein the plurality of clasp straps having clasp members are attached to the lateral and medial portions as well as to the shoe tongue so that the shoe upper is closable upon clasp of the clasp members attached to the shoe tongue and to one of the lateral and medial portions.

13. The footwear of claim 12, wherein the shoe tongue is attached to a toe box of the footwear by a shoe hinge; wherein the shoe hinge is in communication with a motor; wherein the motor is configured to bring the shoe tongue closer to the lateral and medial portions to facilitate the clasp of the clasp members attached to the shoe tongue and to one of the lateral and medial portions.

14. Footwear comprising:

a shoe sole, and a shoe upper having a heel portion, a lateral portion, and a medial portion, wherein a gap exists between the lateral and medial portions, a plurality of clasp straps attached to the lateral and medial portions, a plurality of clasps, each of the plurality of clasps having two clasp members, wherein each of the plurality of clasp straps attaches to one of the clasp members, a shape memory material disposed in the plurality of clasp straps, a trigger source in communication with the shape memory material, a motor disposed in the footwear, the motor being configured to adjust a position of the clasp members with respect to the plurality of clasp straps in order to tighten or loosen a fitting of the footwear, sensors disposed on or beneath interior surfaces of the footwear, and a control unit in communication with the motor, the sensors, and the trigger source, wherein the trigger source is configured to provide a stimulus to the shape memory material;

wherein the shape memory material is configured to transition between a temporary shape and a memorized shape automatically upon receipt of a stimulus, and wherein the transition of the shape memory material causes the two ends of the plurality of clasp straps to move towards to each other, thereby facilitating the clasp of the two clasp members and the closing of the gap between the lateral and medial portions;

wherein the control unit is configured to instruct the trigger source to send a stimulus to the shape memory material; and wherein the control unit is configured to control activation of the motor based on measurements provided by the sensors.

15. The footwear of claim 14, wherein at least one of the plurality of clasps is a magnetic clasp having two magnetic pieces on each magnetic clasp, wherein two magnetic pieces of the magnetic clasp are mutually attracted to each other over a space, such that the clasp members clasp to form an overlap between the two magnetic pieces; and wherein the control unit is configured that, before clasping, the control unit instructs the motor to adjust the position of the second clasp member so that the two distal ends are aligned on top of each other with a magnetic piece on each end facing each other, thereby facilitating the two magnetic pieces to clasp by magnetic force.

16. The footwear of claim 14, further comprising a user input unit in communication with the trigger source and with the control unit, wherein the control unit is configured to control activation of the motor in response to instructions provided by the user input unit, and wherein the trigger source is configured to send a stimulus to the shape memory material in response to instructions provided by a user input unit.

17. The footwear of claim 14, further comprising:

a push button positioned on the heel portion of the shoe upper, wherein the push button is configured to loosen a closed footwear upon a push on the push button so as to open the footwear and release a foot.

18. The footwear of claim 17, wherein the push button is configured to be removably positioned or affixed at a position in the footwear or remotely from the footwear.

19. The footwear of claim 14, wherein the sensors are touch sensors, pressure sensors, force sensors, capacitive sensors, conductivity sensors, light or optical sensors, heat sensors, strain gauges, stress gauges, bend sensors, magnetic sensors, location sensors, accelerometer sensors, mechanical sensors, or a combination thereof;

wherein the sensors are configured such that number, configuration, type and pattern of the sensors in contact with a limb determine timing for closing and tensioning of the plurality of clasp straps so that the plurality of clasp straps are closed sequentially.

20. The footwear of claim 14, further comprising: a rechargeable battery disposed in the footwear, said rechargeable battery in communication with said motor, wherein the rechargeable battery is configured to be recharged by placing the footwear on a charging dock station.

21. The footwear of claim 20, wherein the dock station comprises sensors to detect that a shoe is placed on the dock station so as to switch the dock between the on/off position.

22. The footwear of claim 20, wherein the dock station comprises at least one of radar, lidar, ultrasound, infra-red, laser, and camera sensors to detect that a person is approaching the dock station so as to open a shoe placed on the dock for wearing, making the wearing of a shoe hands free.

* * * * *